US006496172B1

(12) United States Patent
Hirakata

(10) Patent No.: US 6,496,172 B1
(45) Date of Patent: Dec. 17, 2002

(54) LIQUID CRYSTAL DISPLAY DEVICE, ACTIVE MATRIX TYPE LIQUID CRYSTAL DISPLAY DEVICE, AND METHOD OF DRIVING THE SAME

(75) Inventor: Yoshiharu Hirakata, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/276,757

(22) Filed: Mar. 26, 1999

(30) Foreign Application Priority Data

Mar. 27, 1998 (JP) ..... 10-100639

(51) Int. Cl.[7] ..... G09G 3/36
(52) U.S. Cl. ..... 345/96; 345/100
(58) Field of Search ..... 348/793; 345/94, 345/98, 87, 90, 96, 100; 349/42; 359/13

(56) References Cited

U.S. PATENT DOCUMENTS 5,365,284 A * 11/1994 Matsumoto et al. ..... 348/793
5,436,747 A * 7/1995 Suzuki ..... 349/42
5,528,256 A 6/1996 Erhart et al.
5,615,023 A * 3/1997 Yang ..... 359/13
5,790,092 A * 8/1998 Moriyama ..... 345/96
5,808,596 A * 9/1998 Kim ..... 345/98
5,844,538 A * 12/1998 Shiraki ..... 345/98
6,011,530 A * 1/2000 Kawahata et al. ..... 345/90
6,049,319 A * 4/2000 Sakamoto et al. ..... 345/94
6,075,505 A * 6/2000 Shiba et al. ..... 345/87

* cited by examiner

*Primary Examiner*—Steven Saras
*Assistant Examiner*—Uchendu O. Anyaso
(74) *Attorney, Agent, or Firm*—Eric J. Robinson; Robinson Intellectual Property Law Office, PC

(57) ABSTRACT

A liquid crystal display device with no flicker and with bright excellent display is provided. A polarity pattern of a conventional frame inversion driving is one kind of display. A polarity pattern of a conventional source line inversion driving is two kinds of display, and a disclination pattern is one kind of display. On the contrary, in a circuit structure of the present invention, polarity patterns are made to have not less than four kinds, and disclination patterns are made to have not less than two kinds. By this, bright display in which flicker is not included and poor display due to disclination is improved, can be obtained.

37 Claims, 20 Drawing Sheets

POLARITY PATTERNS OF RESPECTIVE PIXELS IN INVERSION DRIVING OF THE PRESENT INVENTION

POLARITY PATTERNS OF RESPECTIVE PIXELS IN INVERSION DRIVING OF THE PRESENT INVENTION

DISCLINATION PATTERNS OF THE PRESENT INVENTION

SCHEMATIC STRUCTURAL VIEW OF ACTIVE MATRIX CIRCUIT

| | | | | | |
|---|---|---|---|---|---|
| A1 | A2 | A3 | A4 | A5 | A6 |
| B1 | B2 | B3 | B4 | B5 | B6 |
| C1 | C2 | C3 | C4 | C5 | C6 |
| D1 | D2 | D3 | D4 | D5 | D6 |

DISPLAY PATTERN

BRIEF VIEW OF PERIPHERY OF SOURCE DRIVER CIRCUIT

BRIEF VIEW OF PERIPHERY OF GATE DRIVER CIRCUIT

SHIFT REGISTER

| | VSEL 1 | VSEL 2 | VSEL 3 | VSEL 4 | V in 1 | V in 2 | V in 3 | V in 4 |
|---|---|---|---|---|---|---|---|---|
| FIRST FRAME | 0 | 0 | 1 | 1 | + | + | - | - |
| SECOND FRAME | 1 | 0 | 0 | 1 | - | + | + | - |
| THIRD FRAME | 1 | 1 | 0 | 0 | - | - | + | + |
| FOURTH FRAME | 0 | 1 | 1 | 0 | + | - | - | + |

VIEW SHOWING CORRESPONDENCE BETWEEN SELECTING SIGNALS VSEL 1 TO VSEL 4 AND INPUT SIGNALS V in 1 TO V in 4 OUTPUTTED FROM SELECTING CIRCUITS

VIEW SHOWING STATE OF ELECTRIC FLUX LINES PRODUCED BETWEEN TWO PIXEL ELECTRODES (TOP VIEW)

MODEL VIEW SHOWING STATE OF ELECTRIC FLUX LINES GENERATED BETWEEN PIXELS (IMMEDIATELY BEFORE LIQUID CRYSTAL MOLECULES RESPOND TO APPLICATION OF ELECTRIC FIELD) (CROSS - SECTIONAL VIEW)

FIG. 15A

POLARITY PATTERN OF RESPECTIVE PIXELS IN FRAME INVERSION DRIVING

| | | | | | |
|---|---|---|---|---|---|
| + | + | + | + | + | + |
| + | + | + | + | + | + |
| + | + | + | + | + | + |
| + | + | + | + | + | + |

POLARITY PATTERN (1)

| | | | | | |
|---|---|---|---|---|---|
| - | - | - | - | - | - |
| - | - | - | - | - | - |
| - | - | - | - | - | - |
| - | - | - | - | - | - |

POLARITY PATTERN (2)

FIG. 15B

POLARITY PATTERN OF RESPECTIVE PIXELS IN GATE LINE INVERSION DRIVING

| | | | | | |
|---|---|---|---|---|---|
| + | + | + | + | + | + |
| - | - | - | - | - | - |
| + | + | + | + | + | + |
| - | - | - | - | - | - |

POLARITY PATTERN (1)

| | | | | | |
|---|---|---|---|---|---|
| - | - | - | - | - | - |
| + | + | + | + | + | + |
| - | - | - | - | - | - |
| + | + | + | + | + | + |

POLARITY PATTERN (2)

FIG. 16A

POLARITY PATTERN OF RESPECTIVE PIXELS IN SOURCE LINE (1 LINE) INVERSION DRIVING

| | | | | | |
|---|---|---|---|---|---|
| + | - | + | - | + | - |
| + | - | + | - | + | - |
| + | - | + | - | + | - |
| + | - | + | - | + | - |

POLARITY PATTERN (1)

| | | | | | |
|---|---|---|---|---|---|
| - | + | - | + | - | + |
| - | + | - | + | - | + |
| - | + | - | + | - | + |
| - | + | - | + | - | + |

POLARITY PATTERN (2)

FIG. 16B

POLARITY PATTERN OF RESPECTIVE PIXELS IN SOURCE LINE (1 LINE) INVERSION DRIVING

| | | | | | |
|---|---|---|---|---|---|
| + | - | + | - | + | - |
| + | - | + | - | + | - |
| + | - | + | - | + | - |
| + | - | + | - | + | - |

DISCLINATION PATTERN (1)

| | | | | | |
|---|---|---|---|---|---|
| - | + | - | + | - | + |
| - | + | - | + | - | + |
| - | + | - | + | - | + |
| - | + | - | + | - | + |

DISCLINATION PATTERN (2)

FIG. 17A

POLARITY PATTERN OF RESPECTIVE PIXELS IN SOURCE LINE (2 LINES SIMULTANEOUS) INVERSION DRIVING

| | | | | | |
|---|---|---|---|---|---|
| + | + | - | - | + | + |
| + | + | - | - | + | + |
| + | + | - | - | + | + |
| + | + | - | - | + | + |

POLARITY PATTERN (1)

| | | | | | |
|---|---|---|---|---|---|
| - | - | + | + | - | - |
| - | - | + | + | - | - |
| - | - | + | + | - | - |
| - | - | + | + | - | - |

POLARITY PATTERN (2)

FIG. 17B

POLARITY PATTERN OF RESPECTIVE PIXELS IN SOURCE LINE (2 LINES SIMULTANEOUS) INVERSION DRIVING

| | | | | | |
|---|---|---|---|---|---|
| + | + | - | - | + | + |
| + | + | - | - | + | + |
| + | + | - | - | + | + |
| + | + | - | - | + | + |

DISCLINATION PATTERN (1)

| | | | | | |
|---|---|---|---|---|---|
| - | - | + | + | - | - |
| - | - | + | + | - | - |
| - | - | + | + | - | - |
| - | - | + | + | - | - |

DISCLINATION PATTERN (2)

LIQUID CRYSTAL DISPLAY DEVICE, ACTIVE MATRIX TYPE LIQUID CRYSTAL DISPLAY DEVICE, AND METHOD OF DRIVING THE SAME

BACKGROUND OF THE INVENTION

1. Field of the Invention

The present invention relates to a driving method suitable for a display which uses a display material such as a liquid crystal and in which display pixels are arranged in a matrix form, and particularly to an alternating current driving method of a liquid crystal panel.

2. Description of the Related Art

In recent years, a technique for manufacturing a semiconductor device in which a semiconductor thin film is formed on an insulating substrate, such as a thin film transistor (TFT), has been rapidly developed. The reason thereof resides in that the demand for a liquid crystal display device (typically, an active matrix type liquid crystal display device) has been increased.

The active matrix type liquid crystal display device displays an image in such a manner that an electric charge going in and out of each of several tens to millions of display pixels arranged in a matrix form is controlled by a switching element of each of the display pixels.

In the present specification, the display pixel indicates a device mainly constituted of a switching element, a pixel electrode connected to the switching element, a liquid crystal, and an opposite electrode disposed opposite to the pixel electrode through the liquid crystal. However, the display pixel in the case of a liquid crystal panel using IPS driving, the display pixel indicates a device mainly constituted of a switching element, a pixel electrode connected to the switching element, a liquid crystal, and a common electrode disposed on the same substrate.

In addition, the common potential in the present specification indicates the potential of the opposite electrode of the display pixel or the potential of the common electrode.

FIG. 2 is a schematic view showing a liquid crystal display device. FIG. 3A is a schematic structural view of an active matrix circuit in a liquid crystal panel 101 in FIG. 2.

In FIG. 2, the liquid crystal panel 101 includes a plurality of (N) scanning lines (corresponding to scanning lines A, B, C, D, . . . in FIG. 3A) extending in parallel to each other in the horizontal direction (lateral direction), a plurality of (M) signal lines (corresponding to signal lines (1), (2), (3), (4), . . . in FIG. 3A) extending in parallel to each other in the vertical direction (longitudinal direction) and crossing the scanning lines at right angles, M×N switching elements (TFTS etc.) respectively disposed in the vicinity of each of the crossing portions of the scanning lines and the signal lines, and a pixel electrode 111 connected to each of the switching elements.

In the liquid crystal panel 101, one end of the scanning line is connected to a gate electrode of each of the switching elements 110, and the other end is connected to a gate driver circuit 104 (scanning line driver circuit). On the other hand, one end of the signal line is connected to a source electrode of each of the switching elements 110 and the other end is connected to a source driver circuit 105 (signal line driver circuit).

FIG. 3B shows a display pattern (display pixels of four rows by six columns (A1 to D6)) as a part of a display region. FIG. 3B corresponds to the pixel electrodes 111 in FIG. 3A. That is, the display pixel A1 is mainly constituted of the switching element 110 disposed at the crossing point of the scanning line A and the signal line (1) in FIG. 3A, the pixel electrode 111 connected to the switching element, an opposite electrode provided opposite to the pixel electrode, and a liquid crystal existing between the pixel electrode and the opposite electrode.

For simplification, FIG. 3 shows only the scanning lines A to D, the signal lines (1) to (6), and the display pixels of four rows by six columns (A1 to D6) forming a part of the display region.

A typical example of display operation of the panel will be described in brief with reference to FIGS. 3A and 3B.

First, in accordance with a signal from a shift register circuit or the like (not shown) in the source driver circuit, only a part (pixel A1) of the lateral direction (horizontal direction) line of picture information (panel input image signal 203) is selectively sampled in the signal line (1), and its signal potential is applied to the entire of the signal line (1). Then a signal potential (turning on the TFT disposed in the vicinity of the crossing place) is applied only to the scanning line A. Only the switching element disposed in the vicinity of the place where the signal line (1) and the scanning line A cross with each other is turned on, so that the signal potential of the signal line (1) is applied to the pixel electrode. The liquid crystal is driven by the applied signal potential and the amount of transmitted light is controlled, so that a part (picture corresponding to A1) of the picture information is displayed on the display pixel A1.

Next, while the state in which the display pixel A1 displays is kept by an auxiliary capacitance or the like, at the next instant, only a part of the lateral direction (horizontal direction) line of the image signal is selectively sampled, and its signal potential is applied to the signal line (2) adjacent to the signal line (1). In this way, similarly to the display pixel A1, a part (picture corresponding to A2) of the picture information is displayed on the display pixel A2.

Such a display operation is sequentially carried out, so that a part (A1, A2, A3, A4, . . . ) of the picture information is sequentially displayed on the first pixel row (row A) in the lateral direction. During this, the scanning line A is applied with a signal which turns on the switching element disposed in the vicinity of each of the places where the scanning line crosses the signal lines.

Subsequently, when writing in all pixels of the first pixel row A in the lateral direction is ended, a signal potential (turning on a switching element disposed in the vicinity of a crossing place) is applied only to the scanning line B. Only a part (pixel B1) of the image signal is sampled in the signal line (1) and its signal potential is held. In the same way, only the pixel row (row B) corresponding to the second row in the lateral direction is sequentially written. Such a display operation is carried out by the number of pixel rows (N rows), so that one picture (frame) is displayed on the display region.

In addition, after one picture (frame) is displayed, in the liquid crystal display using TFTs or the like as switching elements, in order to prevent deterioration of the liquid crystal material, to eliminate display blur, and to keep display quality, signal potentials in which positive and negative polarities are inverted in one frame (one picture) are normally applied (alternating current driving) to the respective display pixels, while common potential is used as a reference.

These display operations are sequentially repeated and a plurality of pictures are obtained, so that images are displayed on the display region 106.

Next, the alternating current driving method briefly described in the above will be described in more detail. Incidentally, polarity patterns of display pixels (four rows by six columns) in conventional typical alternating current driving methods are shown in FIGS. 15A to 15B and FIG. 16A. The polarity patterns of FIGS. 15A and 15B and FIG. 16A correspond to the display pattern (display pixels of four rows by six columns (A1 to D6)) shown in FIG. 2B.

In the drawings (FIG. 1, FIGS. 15A and 15B, FIG. 16A, and FIG. 17A) showing polarity patterns in the present specification, the common potential is made a reference, and in the case where a signal potential applied to a display pixel is positive, "+" is shown, and in the case of negative, "−" is shown.

In addition, as a scanning system, there is interlaced scanning in which scanning lines of one picture (one frame) are divided into two (two fields) and scanning is carried out, and non-interlaced scanning in which scanning lines are sequentially scanned from the above on the picture. Here, examples using the non-interlaced scanning will be mainly described.

In FIG. 15A showing a conventional example, the polarities of image signals applied to all display pixels are inverted every frame, so that this example is called frame inversion driving.

As shown in FIG. 15A, the feature of the frame inversion driving is that signal potentials having the same polarity are applied to all display pixels in one arbitrary frame so that a polarity pattern (1) (positive) is displayed, while the polarity of the signal potentials applied to all the display pixels is inverted into negative so that a polarity pattern (2) (negative) is displayed in the next frame. That is, when attention is paid only to the polarity pattern, the frame inversion driving is a driving method in which two kinds of polarity patterns (polarity pattern (1) and polarity pattern (2)) are repeatedly displayed.

The problem of the conventional frame inversion driving is that a polarity inversion period is as long as one frame, and it becomes a frequency range (about 30 Hz) which can be recognized by a human eye, so that an observer can recognize, as flicker, a subtle difference between the display (1) at the time when the polarity of the image signal is positive and the display (2) at the time when the polarity of the image signal is negative. Especially in halftone display, remarkable flicker is observed.

Another conventional example shown in FIG. 16A is called source line inversion driving.

As shown in FIG. 16A, the feature of the source line inversion driving is that each of the display pixels is applied with a signal potential having a polarity opposite to a signal potential of its adjacent display pixel in the lateral direction (horizontal direction). In one arbitrary frame writing period, image signals having a signal potential of the same polarity (positive) with each other are applied to the display pixels (odd columns) expressed by A1, B1, C1, . . . , A3, B3, C3, . . . , A5, B5, C5, . . . On the other hand, image signals having a signal potential of the same polarity (negative) with each other are applied to the display pixels (even columns) expressed by A2, B2, C2, . . . , A4, B4, C4, . . . , A6, B6, C6, . . . In this way, a polarity pattern (1) is displayed. Then, in a next frame writing period, an image signal having the polarity opposite to the polarity pattern (1) displayed in the proximate frame writing period is applied to each of the display pixels so that a polarity pattern (2) is displayed.

That is, as shown in FIG. 16A, similarly to the conventional frame inversion driving, the conventional source line inversion driving is also a driving method in which two kinds of polarity patterns (polarity pattern (1) and polarity pattern (2)) are repeatedly displayed.

FIG. 18 shows an example of a timing chart of a panel input signal when the conventional source line inversion driving is used and a white picture is displayed on the display region of a liquid crystal panel which is normally black. The signal corresponds to the display pattern (display pixels of four rows by six columns (A1 to D6)) shown in FIG. 2B and FIG. 16A.

Another conventional example shown in FIG. 15B is called gate line inversion driving.

As shown in FIG. 15B, the feature of the gate line inversion driving is that each of the display pixels is applied with an image signal having a polarity opposite to its adjacent display pixel in the longitudinal (vertical) direction. In this method, the polarity of the signal potential of the image signal is inverted from positive to negative or from negative to positive every horizontal scanning period.

That is, similarly to the conventional driving method, this is a driving method in which two kinds of polarity patterns (polarity pattern (1) and polarity pattern (2)) are repeatedly displayed.

By this source line inversion driving and gate line inversion driving, flicker which is a problem in the frame inversion driving is reduced. However, the problem of the source line inversion driving and the gate line inversion driving is that since a stripe called disclination is produced between adjacent display pixels applied with opposite polarities, so that the brightness of the entire display picture is lowered.

In the present specification, the disclination means poor display (light loss in the case of normally white display, light leak in the case of normally black display) due to disturbance of an oriented state of liquid crystal caused by the potential difference which is produced between the display pixel applied with the image signal having the positive polarity and the display pixel applied with the image signal having the negative polarity.

The potential difference between the adjacent display pixels is produced from electric flux lines shown in FIGS. 14(1) and 14(2). FIG. 14(1) is a top view showing the state of electric flux lines produced between two pixel electrodes (1) and (2) when an effective electric field (positive or negative) is applied to the pixel electrodes (1) and (2) in the direction vertical to the paper surface. FIG. 14(2) is a sectional view. However, for convenience, FIG. 14(1) shows only the electric flux lines produced in the lateral direction between the pixel electrodes (1) and (2), and FIG. 14(2) shows the state of the electric flux lines immediately before liquid crystal molecules oriented in the vertical direction respond to the application of the electric field.

FIG. 16B shows a disclination pattern corresponding to FIG. 16A. In FIG. 16B, the disclination is formed at a fixed position, and although the polarities of the signal potentials applied to the display pixels are different, the disclination pattern (1) is substantially the same as the disclination pattern (2).

In addition, although not shown, as another alternating current driving method, there is proposed an alternating current driving method (dot inversion driving) in which the polarity of an image signal is inverted for every writing of all adjacent display pixel and the inverted signal is applied to the display pixel. In the dot inversion driving, the polarities of adjacent pixels are different from each other, so that the influence of a potential difference produced between the adjacent display pixels is great and the disclination greatly influences the display.

As described above, in the conventional alternating current driving methods (source line inversion driving and gate line inversion driving), like the example shown in FIGS. 16A and 16B, the polarity pattern (1) and the polarity pattern (2) are repeatedly displayed, and the disclination is continuously formed at the fixed position between adjacent display pixels having different polarities, so that the brightness of the picture is lowered. In addition, the same can be said of another alternating current driving method (dot inversion driving).

In another alternating current driving method (frame inversion driving), although the disclination is not produced, flicker is produced.

The number of display pixels of a display has been increasing year after year, and a driving frequency becomes very high for a panel with a large number of display pixels. For example, it is said that the NTSC standard requires about 400 thousand display pixels, and the HDTV standard requires about 2 million display pixels. Thus, the maximum frequency of an input image signal is about 6 MHz in the NTSC standard, and about 20 MHz to 30 MHz in the HDTV standard. In order to accurately display this image signal, a clock signal is required to have a frequency (for example, about 50 MHz to 60 MHz) several times that of this image signal. In future, it is expected that display of high fineness and high picture quality is increasingly required, and an image signal with a very fast dot clock is to be treated.

Hitherto, it has been difficult to accurately make alternating current of an image signal and a clock signal having such a high frequency band range and to drive a liquid crystal panel. This is because a liquid crystal material used in a conventional LCD has a slow speed (several tens ms to hundreds ms) of response from application of a potential, and even if a driver circuit is constituted of TFTs which use, for example, amorphous silicon or polycrystalline silicon and can operate in a high frequency band region, the liquid crystal material can not respond to the high speed operation, which is a problem.

SUMMARY OF THE INVENTION

The present invention has been made to solve such problems, and therefore an object of the present invention is to provide a liquid crystal display device which has no flicker and can obtain bright display, and to provide a method of driving the same.

According to a first aspect of the present invention, a liquid crystal display device comprises a liquid crystal panel including a pair of substrates and a liquid crystal sealed between them, wherein N scanning lines, M signal lines, and M×N display pixels respectively disposed at each of crossing portions between the scanning lines and the signal lines are disposed on one of the substrates, and an image signal having a positive or negative polarity is applied to each of the display pixels so as to make image display, the liquid crystal display device being characterized in that the image signals with the same polarity are applied for every n ($M>n\geqq 2$) adjacent lines of the signal lines, and a boundary portion between a group of the display pixels connected to the n signal lines applied with the image signals having the positive polarity and a group of the display pixels connected to the n signal lines applied with the image signals having the negative polarity is periodically moved.

The display device of the above aspect is characterized in that the boundary portion is moved every frame or field interval.

Moreover, the active matrix type liquid crystal display device of the above aspect is characterized in that the liquid crystal panel includes at least two image signal wiring lines, and the image signal wiring lines include a first image signal wiring line applied with the image signal having the positive polarity, and a second image signal wiring line applied with the image signal having the negative polarity.

Moreover, the display device of the above aspect is characterized in that the liquid crystal panel includes a switching element at each of the crossing portions between the scanning lines and the signal lines, and the scanning lines, the signal lines, and the switching element are formed on the same substrate.

Moreover, the display device of the above aspect is characterized in that the liquid crystal panel includes a polarity selecting circuit for selecting the polarity of the image signal applied to the signal lines, and the signal lines, the scanning lines, the switching element, and the polarity selecting circuit are formed on the same substrate.

According to a second aspect of the present invention, an active matrix type liquid crystal display device comprises a display region constituted of display pixels arranged in a matrix form, an image signal having a positive or negative polarity being written in the display pixels so as to make image display, wherein the active matrix type liquid crystal display device is characterized by comprising a circuit for forming the image signal which sequentially displays at least four kinds of polarity patterns on the display region.

The display device according to the second aspect is characterized by comprising a circuit which sequentially displays at least four kinds of polarity patterns on the display region every one frame or one field interval, and sequentially displays them in one period of frames the number of which is the same as that of the kinds of polarity patterns.

Moreover, the active matrix type liquid crystal display device according to the second aspect is characterized by comprising a circuit which inverts the polarity of the image signal applied to the respective display pixels every plural frame or plural field periods.

According to a third aspect of the present invention, a method of driving an active matrix type liquid crystal display device which includes a display region constituted of display pixels of x rows by y columns arranged in a matrix form and in which an image signal having a positive or negative polarity is written in each of the display pixels so as to make image display, the method being characterized in that Z kinds of polarity patterns are displayed on the display region.

The method of driving the active matrix type liquid crystal display device according to the third aspect is characterized in that the Z kinds of polarity patterns are displayed every frame interval, and are sequentially displayed in one period of the Z frames.

The method of driving the active matrix type liquid crystal display device according to the third aspect is characterized in that the Z ($Z=4$) kinds of polarity patterns are sequentially displayed on the display region constituted of the display pixels of x rows by y columns arranged in a matrix form.

According to a fourth aspect of the present invention, an active matrix type liquid crystal display device comprises a liquid crystal panel including a display region constituted of a liquid crystal sealed between a pair of substrates, N scanning lines, M signal lines, and N×M display pixels respectively disposed at each of crossing portions between the scanning lines and the signal lines, the scanning lines, the signal lines, and the display pixels being disposed on one of the substrates, wherein the liquid crystal display device is characterized in that at least two kinds of different disclination patterns are displayed on the display region.

According to a fifth aspect of the present invention, a method of driving an active matrix type liquid crystal display device which comprises a liquid crystal sealed between a pair of substrates, and a display region constituted of display pixels arranged in a matrix form, and in which an image signal having a positive or negative polarity is written in each of the display pixels so as to make image display, the method being characterized in that at least two kinds of different disclination patterns are displayed on the display region.

The method of driving the display device according to the fifth aspect is characterized in that the disclination patterns are sequentially displayed on the display region every frame or field interval.

BRIEF DESCRIPTION OF THE DRAWINGS

FIGS. 15A and 15B are views showing conventional polarity patterns.

FIGS. 16A and 16B are views showing a conventional polarity pattern and a disclination pattern, respectively.

FIGS. 17A and 17B are views showing a conventional polarity pattern and a disclination pattern, respectively.

DETAILED DESCRIPTION OF THE PREFERRED EMBODIMENTS

Hereinafter, a structure of the present invention will be described while comparison with a conventional structure will be made. A1though an example using non-interlaced scanning will be described, it is needless to say that the present invention is not limited to the non-interlaced scanning but can be applied to other scanning systems such as interlaced scanning.

Similarly, the present invention is not limited to an active matrix type liquid crystal display device, but can be applied to other liquid crystal display devices such as a passive type liquid crystal display device.

Figure 19A:
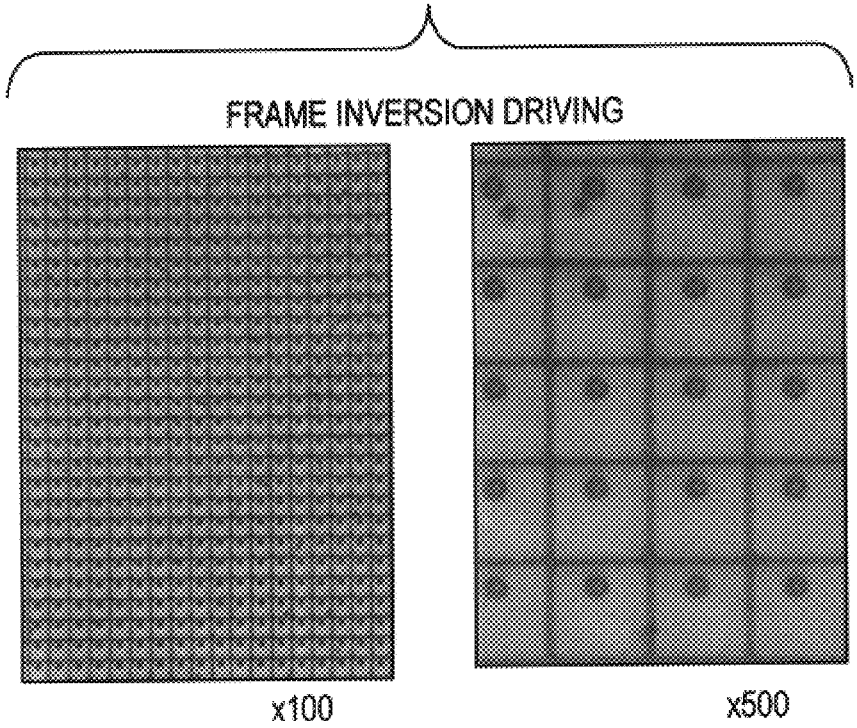
FIGS. 19A and 19B are views of microphotographs showing conventional disclination patterns.
Figure 19B:
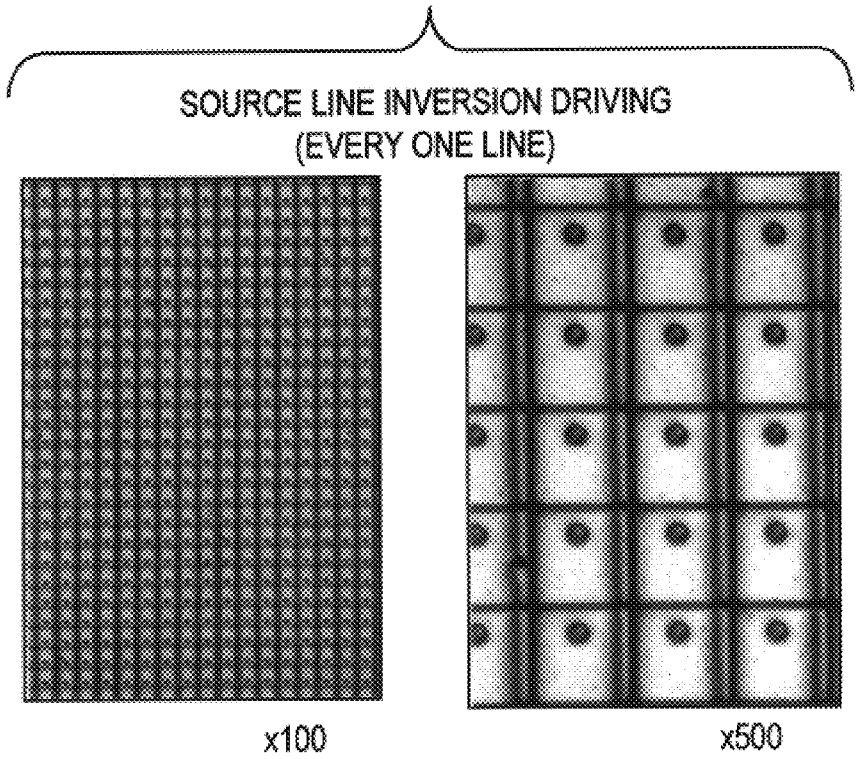

As shown in FIG. 16A, the conventional source line inversion driving is a method in which display of two kinds of polarity patterns (polarity pattern (1) and polarity pattern (2)) is repeated every frame. The disclination patterns produced at this time have, as shown in FIG. 16B, substantially one kind. The present inventors carried out experiments by use of simple display pixels. FIG. 19B is a microphotograph of disclination stripes produced for every one column.

Figure 18:
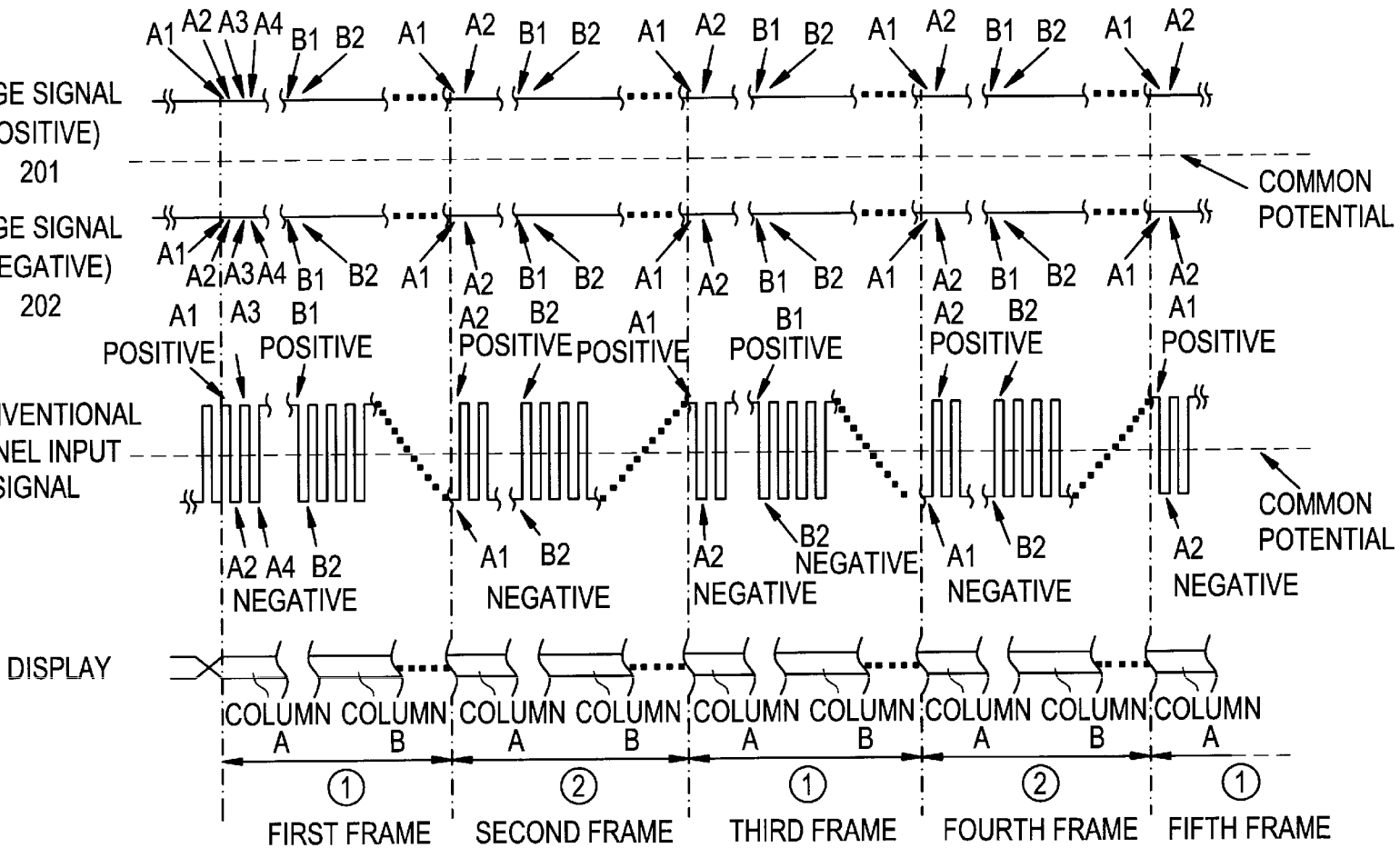
FIG. 18 is a view showing a conventional timing chart.

FIG. 18 shows an example of a timing chart of a panel input signal when a white picture is displayed on the entire surface of a display region of a liquid crystal panel which is normally black. Like this, when an interval between inverted display pixel columns is small (every one line in FIG. 16B), although the disclination pattern is not recognized by a human eye as a disclination stripe, the brightness of the entire display picture is reduced.

Figure 20A:
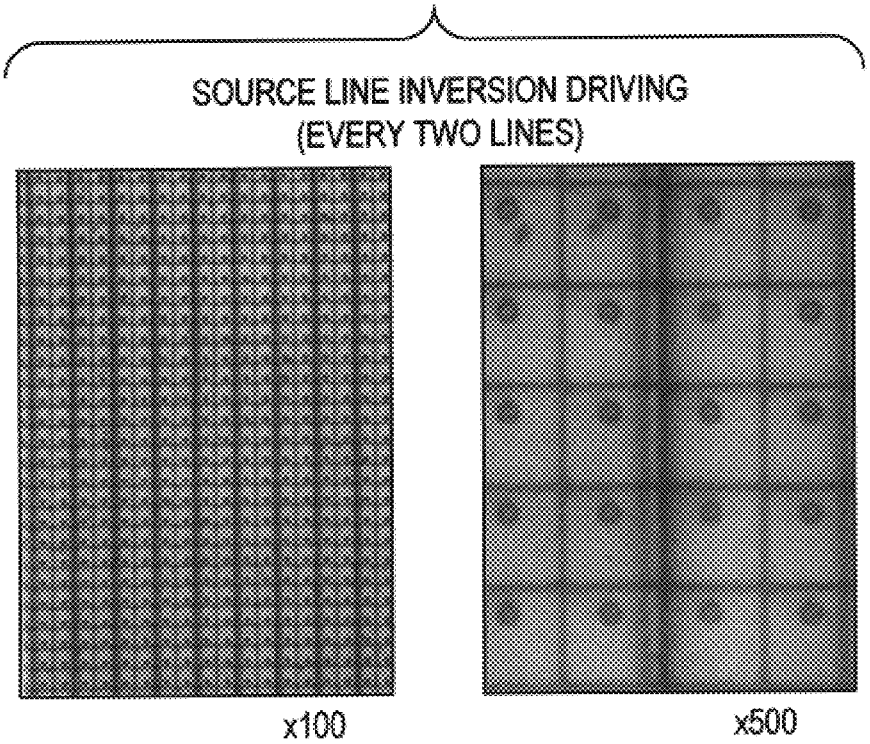
FIGS. 20A and 20B are views of microphotographs showing conventional disclination patterns.

Then the present inventors carried out experiments by use of simple display pixels, and carried out the source line inversion driving, as shown in FIG. 17A, by inverting polarities of signal potentials for every plural columns (two lines) at the same time. As compared with the conventional source line (one column) inversion driving, the number of disclination stripes was halved, so that the entire of the display picture became bright. FIG. 20A is a microphotograph of a stripe pattern of disclination produced at this time for every two columns.

However, as shown in FIG. 17B, the produced disclination pattern has one kind, similarly to FIG. 16B. Thus, the disclination is continuously formed at a fixed position, and an interval between adjacent disclination stripes becomes larger (two columns in FIG. 17B), so that there occurs a problem that the stripe pattern of disclination is recognized by a human eye.

Figure 20B:
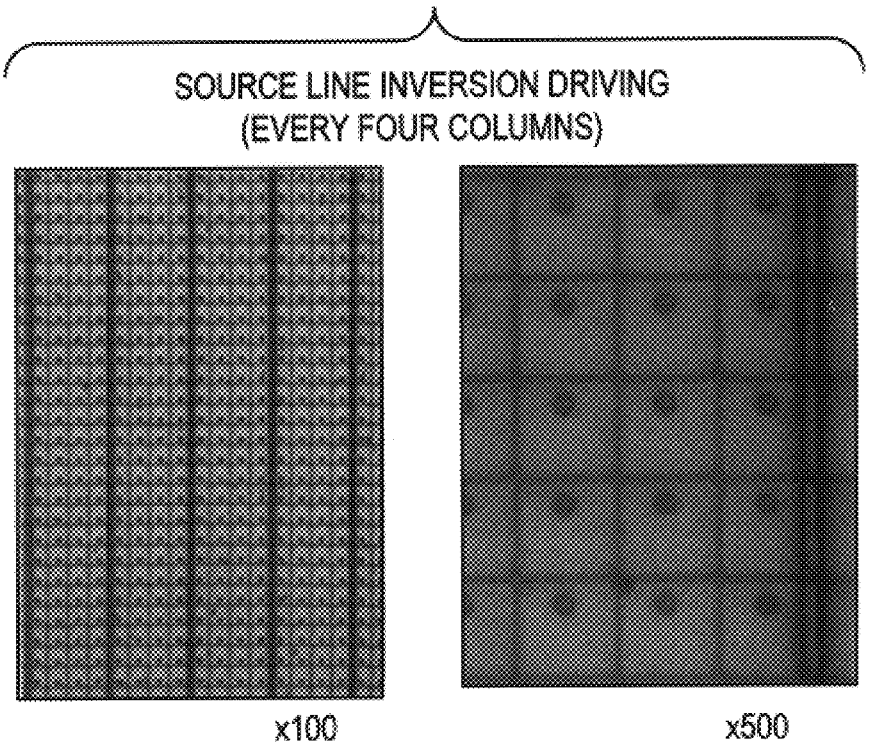

In addition, the present inventor carried out the source line inversion driving by inverting the polarity of a signal potential for every plural lines (four columns) at the same time. As compared with the source line (two columns) inversion driving, although the entire display picture became bright, disclination stripes became noticeable. FIG. 20B is a microphotograph of a stripe pattern of disclination produced at this time for every four columns.

In the conventional frame inversion driving, since polarities of all signal potentials applied between adjacent display pixels in one frame are the same, disclination is not formed and the brightest display is obtained. FIG. 19A is a microphotograph of the display using the frame inversion driving at this time.

However, the conventional frame inversion driving has a long polarity inversion period, and has a frequency range (about 30 Hz) which can be recognized by a human eye, so that flicker occurs. In the case where the tone of a displayed image is clear, this flicker does not become noticeable at about 60 Hz. However, in the case where a pale color is displayed in a halftone, the flicker becomes noticeable at about 60 Hz through fluctuation of TFT element characteristics. According to the experiments carried outs by the present inventors, it was impossible to eliminate this flicker completely when the frequency was less than 100 Hz. Besides, as shown in FIG. 15A, the conventional frame inversion driving was merely inversion driving in which two kinds of polarity patterns (polarity pattern (1) and polarity pattern (2)) were repeated every frame.

Table 1 shows the comparison of brightness (luminance) of display in the respective methods of inversion driving. As a measuring apparatus, a luminance meter (BM7; made by Topcon Corporation) was used.

TABLE 1

| Inversion driving method | Number of lines of inversion driving | Luminance (cd/m$^2$) |
|---|---|---|
| Frame inversion | | 480 |
| Line inversion driving | every one line | 350 |
| | every two lines | 410 |
| | every four lines | 460 |

Contrary to these methods of conventional inversion driving, the inversion driving of the present invention is characterized in that not less than four polarity patterns are sequentially displayed every frame (every field in the case of interlaced scanning).

Figure 1A:
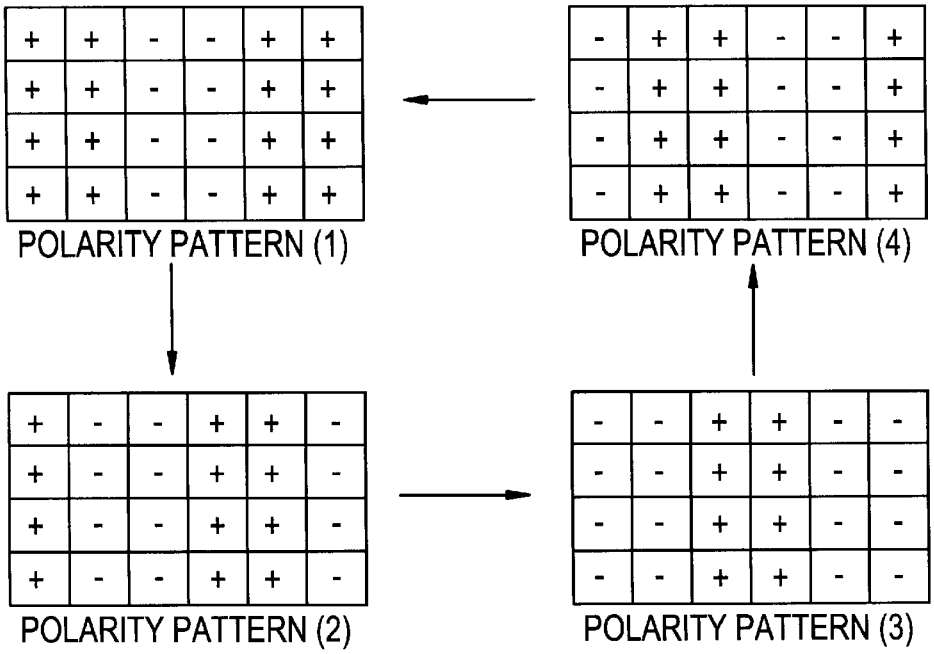
FIGS. 1A and 1B are views showing an example (embodiment 1) of a polarity pattern and a disclination pattern of the present invention.

As shown in FIG. 1A, the inversion driving of the present invention sequentially displays four kinds of polarity patterns (polarity patterns (1) to (4)) every frame (every field in the case of interlaced scanning).

Figure 2:
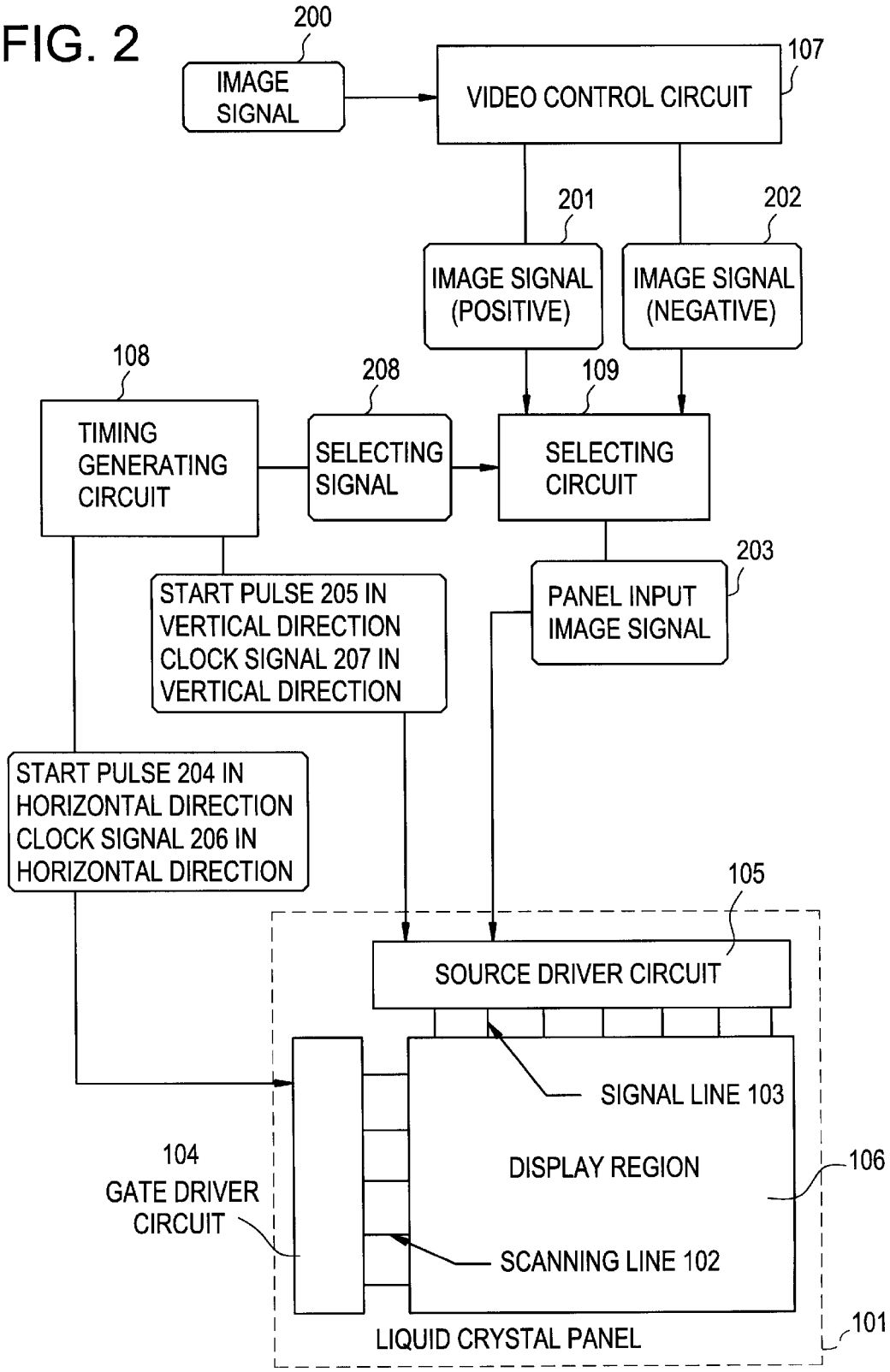
FIG. 2 is a block diagram showing an example (embodiment 1) of a driver circuit of the present invention.

That is, the present invention, as shown in FIG. 1A showing four kinds of polarity patterns, is an inversion driving method in which:

- a state of a polarity pattern (1) (signal potentials having the positive polarity are applied to the display pixels at columns 1, 2, 5, and 6, and signal potentials having the negative polarity are applied to the display pixels at columns 3 and 4);
- a state of a polarity pattern (2) (signal potentials having the positive polarity are applied to the display pixels at columns 1, 4, and 5, and signal potentials having the negative polarity are applied to the display pixels at columns 2, 3 and 6);
- a state of a polarity pattern (3) (signal potentials having the positive polarity are applied to the display pixels at columns 3 and 4, and signal potentials having the negative polarity are applied to the display pixels at columns 1, 2, 5 and 6); and
- a state of a polarity pattern(4) (signal potentials having the positive polarity are applied to the display pixels at columns 2, 3, and 6, and signal potentials having the negative polarity are applied to the display pixels at columns 1, 4 and 5), are sequentially displayed every frame (every field in the case of interlaced scanning). Means for displaying the polarity patterns includes, as shown in FIG. 2 which shows an example of the means, a selecting circuit 109 and a timing generating circuit 108 for forming a selecting signal 208 to be inputted in the selecting circuit.

Although the polarity pattern of the present invention is displayed every frame (every field in the case of interlaced scanning), as shown in FIG. 1A, the polarity of the signal potential applied to each of the display pixels is inverted every two frame periods, which is one of the features of the present invention.

Figures 3A, 3B:
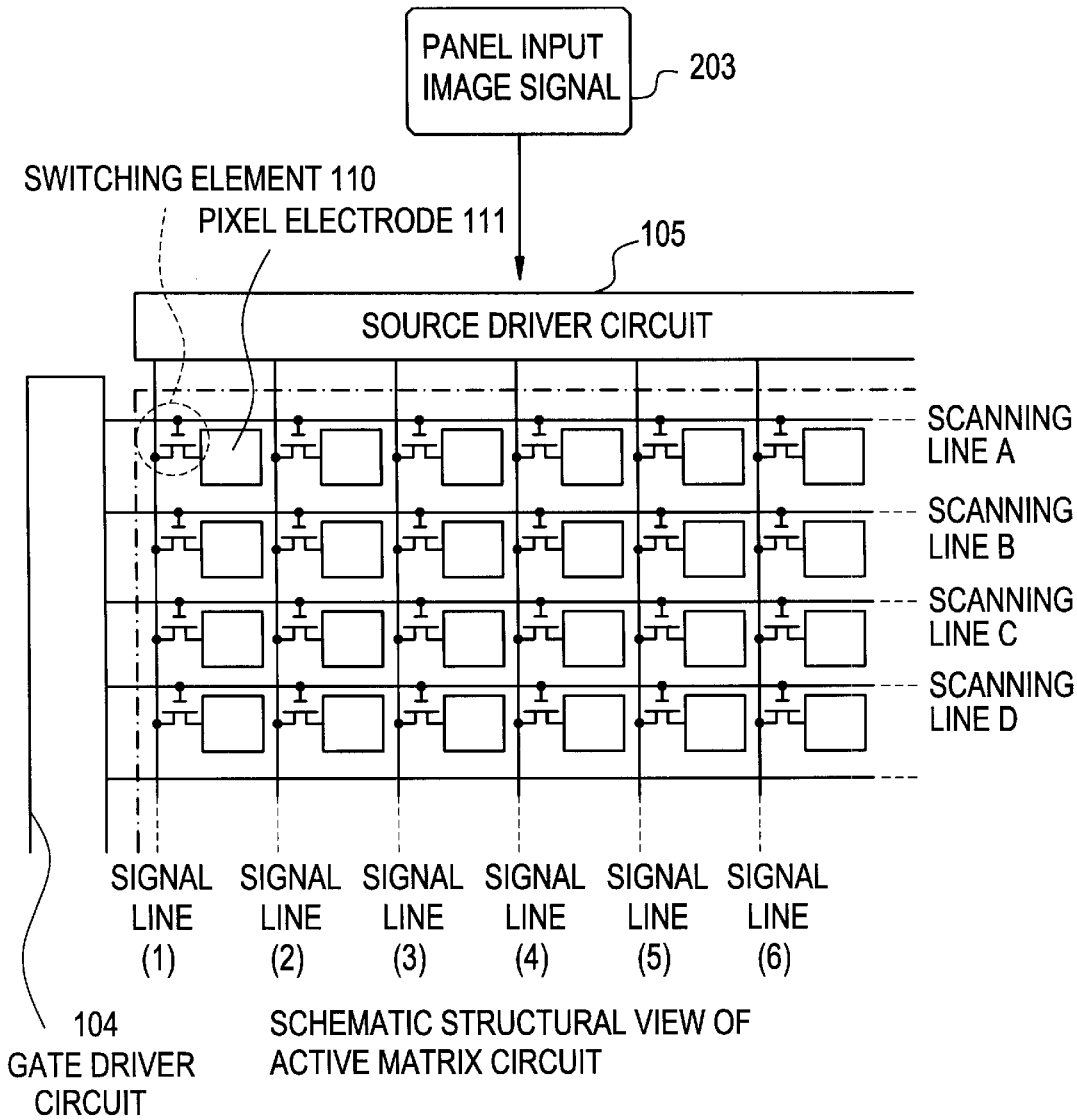
FIGS. 3A and 3B are a schematic structural view of a driver circuit of the present invention and a view showing a display pattern, respectively.
Figure 4:
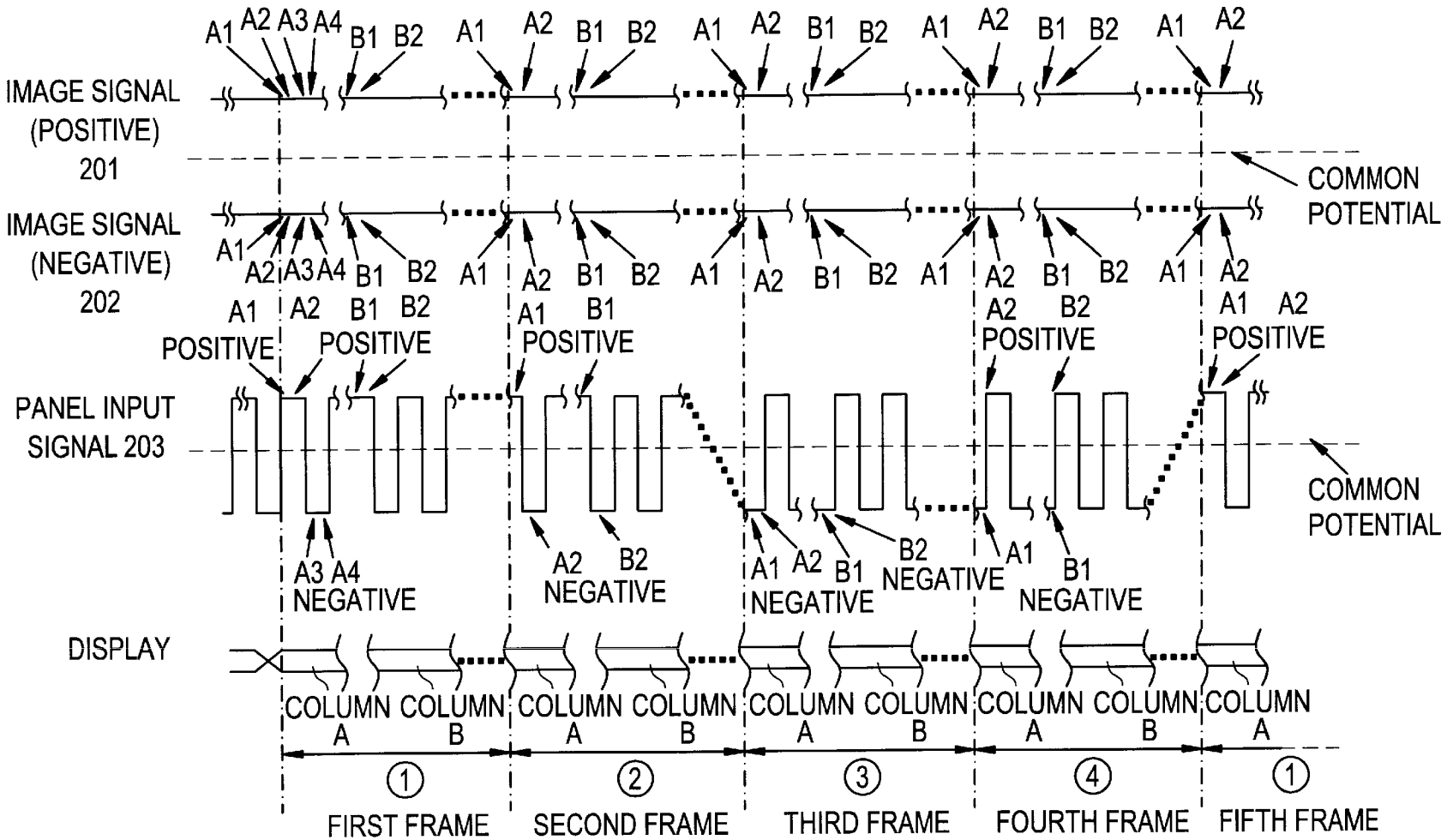
FIG. 4 is a view showing an example (embodiment 1) of a timing chart of the present invention.

FIG. 4 shows an example of a timing chart of a panel input signal potential when a white picture is displayed on a display region of a liquid crystal panel which is normally black. This signal corresponds to the display pattern (display pixels of four rows by six columns (A1 to D6)) shown in FIG. 3B and FIG. 1A. When the timing chart of the present invention (FIG. 4) is compared with the conventional timing chart (FIG. 18), the difference can be clearly recognized.

When the inversion driving of the present invention is used, not less than two different disclination patterns are sequentially displayed every frame (every field in the case of interlaced scanning).

Figure 1B:
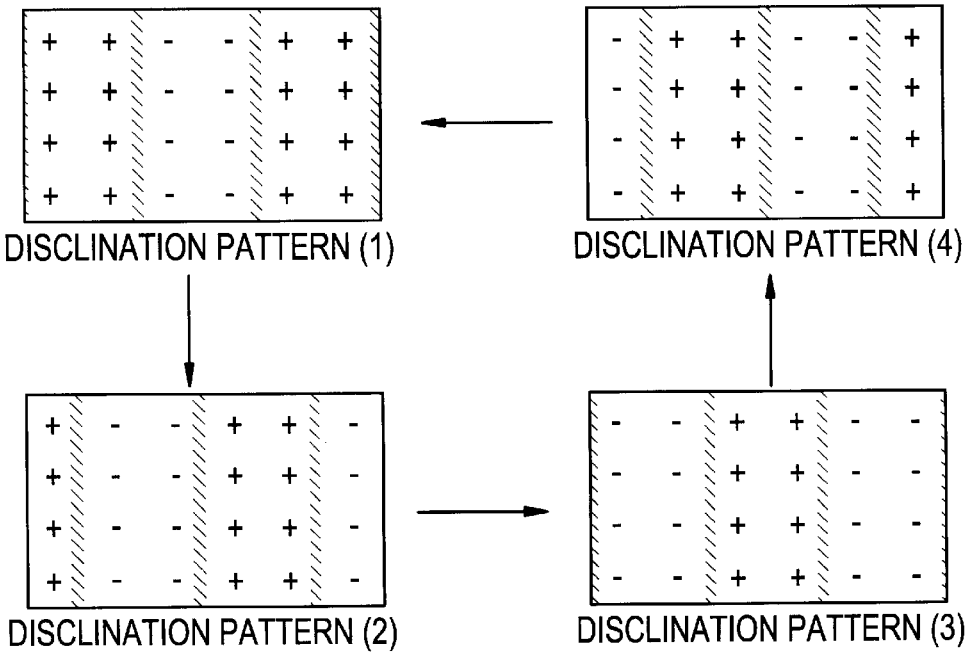

That is, as shown in FIG. 1B which shows an example of two kinds of different disclination patterns, in the present invention:

- a state of a disclination pattern (1) (between the display pixel of the second column and the display pixel of the third column, and between the display pixel of the fourth column and the display pixel of the fifth column);
- a state of a disclination pattern (2) (between the display pixel of the first column and the display pixel of the second column, between the display pixel of the third column and the display pixel of the fourth column, and between the display pixel of the fifth column and the display pixel of the sixth column);
- a state of a disclination pattern (3) (the same as the state of (1)); and
- a state of a disclination pattern(4) (the same as the state of (2)), are sequentially displayed every frame (every field in the case of interlaced scanning). That is, two kinds of different disclination patterns are sequentially displayed.

Like this, according to the structure of the present invention, although the disclination is produced, when attention is paid to one frame (one field in the case of interlaced scanning), it is possible to reduce the number of disclination stripes as compared with that of disclination stripes produced by the conventional source line inversion driving and gate line inversion driving.

Moreover, as shown in FIG. 1B, in the structure of the present invention, writing is carried out while the polarity of the signal potential is inverted for every plural lines (two lines) at the same time, so that the interval between adjacent disclination stripes becomes larger. However, the state of the different disclination pattern (2) is displayed between the state (1) and the state (3), so that it is possible to make such a state that the disclination can not be recognized as a stripe pattern by a human eye.

That is, according to the structure of the present invention, the picture display can be made brighter than the display by the conventional source line inversion driving (every one line), and the flicker produced by the conventional frame inversion driving can be eliminated.

In the following, preferred embodiments of the present invention will be described in more detail. However, it is needless to say that the present invention is not limited to these embodiments.

Embodiment 1

FIG. 2 is a block diagram of a liquid crystal display device. Here, for simplification of explanation of the present invention, an example in which one panel input image signal 203 is formed by a driver circuit of the present invention and four kinds of polarity patterns are made, will be described. In this embodiment, although a liquid crystal is used as a display material, the present invention is not limited to this as long as display pixels in a display are arranged in a matrix form.

A liquid crystal panel 101 has such a structure that a liquid crystal is sealed between a pair of substrates, and a gate driver circuit 104, a source driver circuit 105, and a display region 106 are disposed on the same substrate. The source driver circuit and the gate driver circuit shown in FIG. 2 may be provided outside the panel.

The display region 106 includes a plurality of scanning lines 102 extending in parallel to each other in the horizontal direction (lateral direction), a plurality of signal lines 103 extending in parallel to each other in the vertical direction (longitudinal direction) and crossing the scanning lines at right angles, a switching element 110 disposed in the vicinity of each of crossing portions of the scanning lines and the signal lines, and a pixel electrode 111 connected to the switching element. Display pixels are arranged in a matrix form in the display region 106.

One end of the scanning line is connected to a gate electrode of each of the switching elements, and the other end is connected to the gate driver circuit 104 (scanning line driver circuit). The gate driver circuit outputs a scanning signal to the corresponding scanning line 102.

One end of the signal line 103 is connected to a source electrode of each of the switching elements, and the other end is connected to the source driver circuit 105 (signal line driver circuit). The source driver circuit outputs an image signal to the corresponding signal line.

In this embodiment, although a thin film transistor (TFT) is used as the switching element 110, any switching element can be applied as long as it has the same function. For example, a MIM element, a TFD, or a diode element may be used.

The operation of one display pixel will be described with reference to FIG. 2 and FIGS. 3A and 3B. The operation of one display pixel is the same as a conventional one. When a scanning signal is turned on (becomes a high potential), the switching element is turned on, and image information applied to the signal line is written in the display pixel and display pixel capacitance. By the potential of the signal (panel input image signal) having this image information, the liquid crystal is driven and the amount of transmitted light is controlled, so that the image signal is displayed.

An image signal 200 having image information is normally a signal corresponding to a CRT, and is not a signal suitable for a liquid crystal panel. Thus, various kinds of signal processing are carried out by a video control circuit 107. In this embodiment, an analog signal is used as the image signal 200. However, it is needless to say that this embodiment can be applied even if the image signal is a digital signal.

The video control circuit mainly carries out various kinds of processing such as A/D conversion (if the image signal 200 is a digital signal, this is not particularly required) for facilitating signal processing, γ correction in view of liquid crystal characteristics, signal dividing correction for decreasing the frequency of the image signal, polarity inversion for improving the reliability of the liquid crystal, correction of a phase shift, amplification of a signal, and D/A conversion. In this embodiment, the image signal subjected to various corrections is divided into two, so that a pair of analog signals having symmetry with respect to a common potential (0 V), that is, an image signal (positive) 201 having a positive polarity and an image signal (negative) 202 having a negative polarity are outputted.

In the selecting circuit of this embodiment, by using the selecting signal from the timing generating circuit 108, a panel input image signal displaying four kinds of polarity patterns is obtained from the image signal (positive) and the image signal (negative) processed by the video control circuit 107.

That is, the polarity of the panel input image signal is determined by the selecting signal and the selecting circuit 109. The feature of the driving method of the present invention is to form the panel input image signal, which can display not less than four polarity patterns, by the driver circuit (mainly the selecting signal and the selecting circuit).

However, it is needless to say that the sequence of signal processing until the panel input image signal 203 is obtained from the image signal 200 can be suitably changed according to the circuit design.

In this embodiment, as an example of the panel input image signal which can display not less than four polarity patterns, a panel input image signal displaying four kinds of polarity patterns is shown in FIG. 4. Such a panel input signal is obtained by the driver circuit (mainly the selecting signal and the selecting circuit). In FIG. 4, the simplest display image (white display of the whole surface in a liquid crystal panel which is normally black) is used. FIG. 1A is a view showing the polarity of each of the display pixels displayed by this panel input image signal in this embodiment. FIG. 1B shows a disclination pattern.

Although the disclination is produced in the thus obtained display region, when attention is paid to one frame, the number of disclination stripes is reduced as compared with the number of disclination stripes produced by the conventional source line inversion driving and gate line inversion driving. Thus, as compared with the conventional source line inversion driving and gate line inversion driving, bright display can be obtained. Moreover, flicker which has occurred in the display of the frame inversion driving is not noticeable.

In the structure of the present invention, as shown in FIG. 1B, when attention is paid to the state (1) and the state (3), writing is carried out while the polarity of the image signal is inverted for every plural lines (two lines) at the same time. However, the state (2) exists between the display of the state (1) and the display of the state (3), and the state(4) exists between the display of the state (3) and the display of the state (1). That is, since two kinds of disclination patterns exists, the disclination can not be recognized as a stripe by a human eye.

That is, in this embodiment, since writing is carried out while the polarity of the image signal is inverted for every plural lines (two lines) at the same time, as compared with the conventional case (every one line), the display can be made brighter by about 20%, and the liquid crystal panel with no flicker can be obtained.

In this embodiment, the structure of each of the video control circuit, the selecting circuit, the timing generating circuit, the source driver circuit, and the gate driver circuit is one example, and it is needless to say that the structure can be suitably changed as long as it has the same function. Alternatively, a part or all of the driver circuits may be provided on the same substrate to make integration.

Embodiment 2

The embodiment 1 shows the example of the driver circuit which forms one image signal displaying four kinds of polarity patterns. In this embodiment, an example of a peripheral driver circuit which forms four kinds of image signals displaying four kinds of polarity patterns and inputs them in a panel, will be described with reference to FIGS. 5 to 13.

Figure 5:
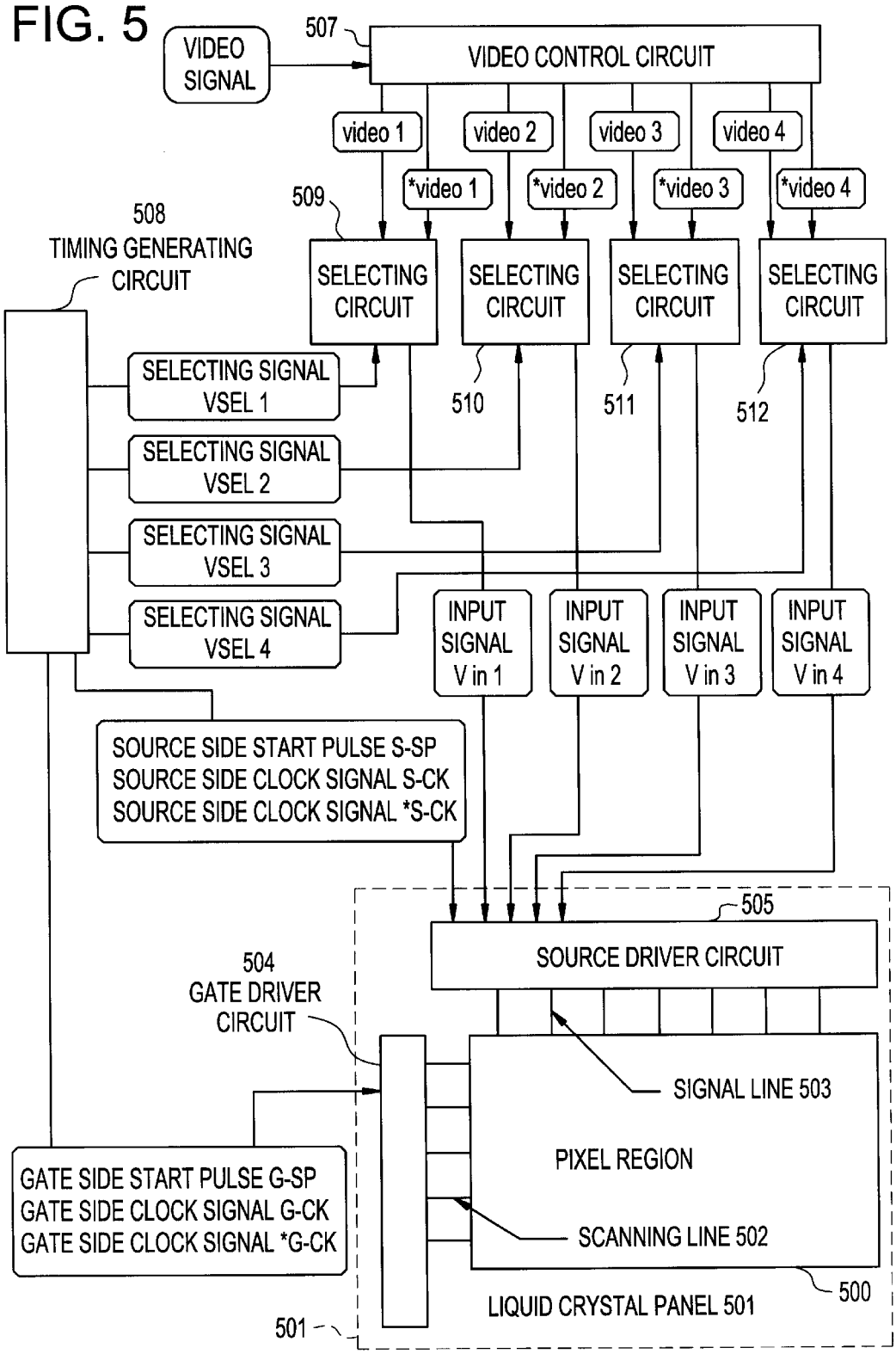
FIG. 5 is a block diagram showing an example (embodiment 2) of a driver circuit of the present invention.
Figure 9:
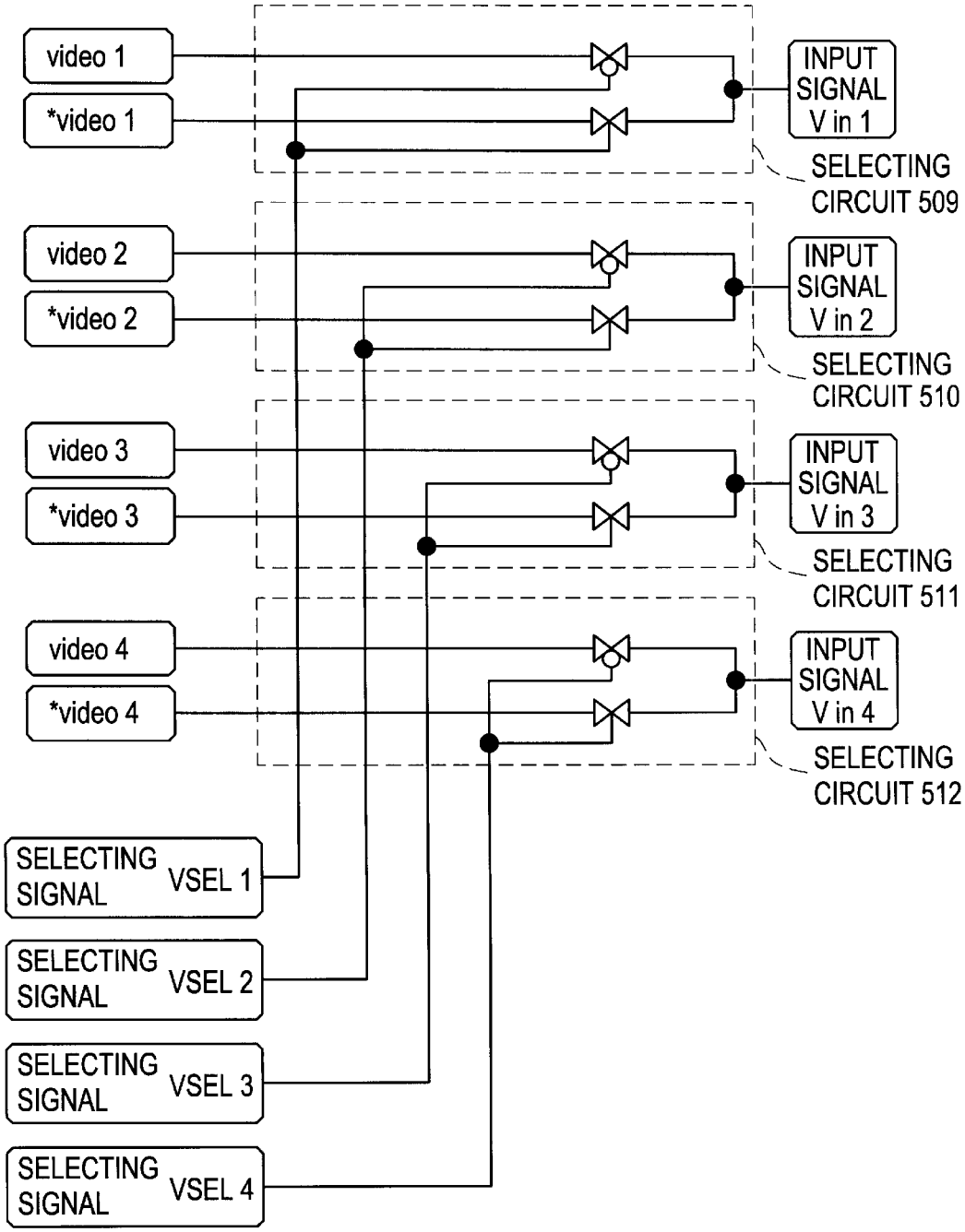
FIG. 9 is a view showing an example (embodiment 2) of a selecting circuit of the present invention.

FIG. 5 is a block diagram showing a liquid crystal display device of this embodiment. As peripheral circuits of this embodiment, a video control circuit 507, a timing generating circuit 508, and four selecting circuits 509, 510, 511, and 512 are used. FIG. 9 shows a specific example of the four selecting circuits.

A liquid crystal panel 501 of this embodiment is constituted of a display pixel region 500 (1024 display pixel rows by 768 display pixel columns), a gate driver circuit 504, and a source driver circuit 505.

The gate driver circuit 504 outputs a scanning signal to a corresponding scanning line 502. The source driver circuit 505 outputs an image signal to a corresponding signal line 503.

Figure 6:
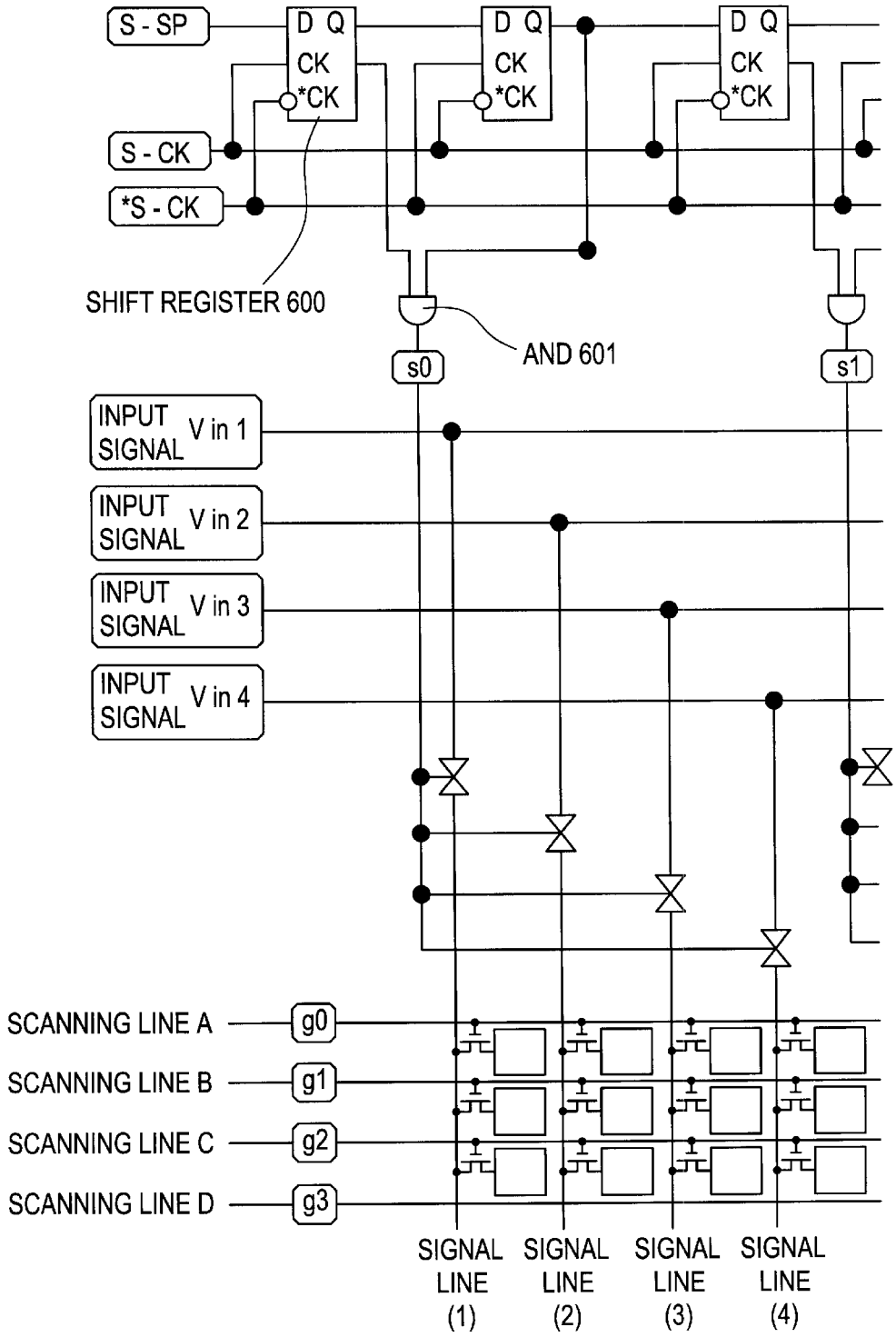
FIG. 6 is a view showing an example (embodiment 2) of a source driver circuit of the driver circuit of the present invention.
Figure 7:
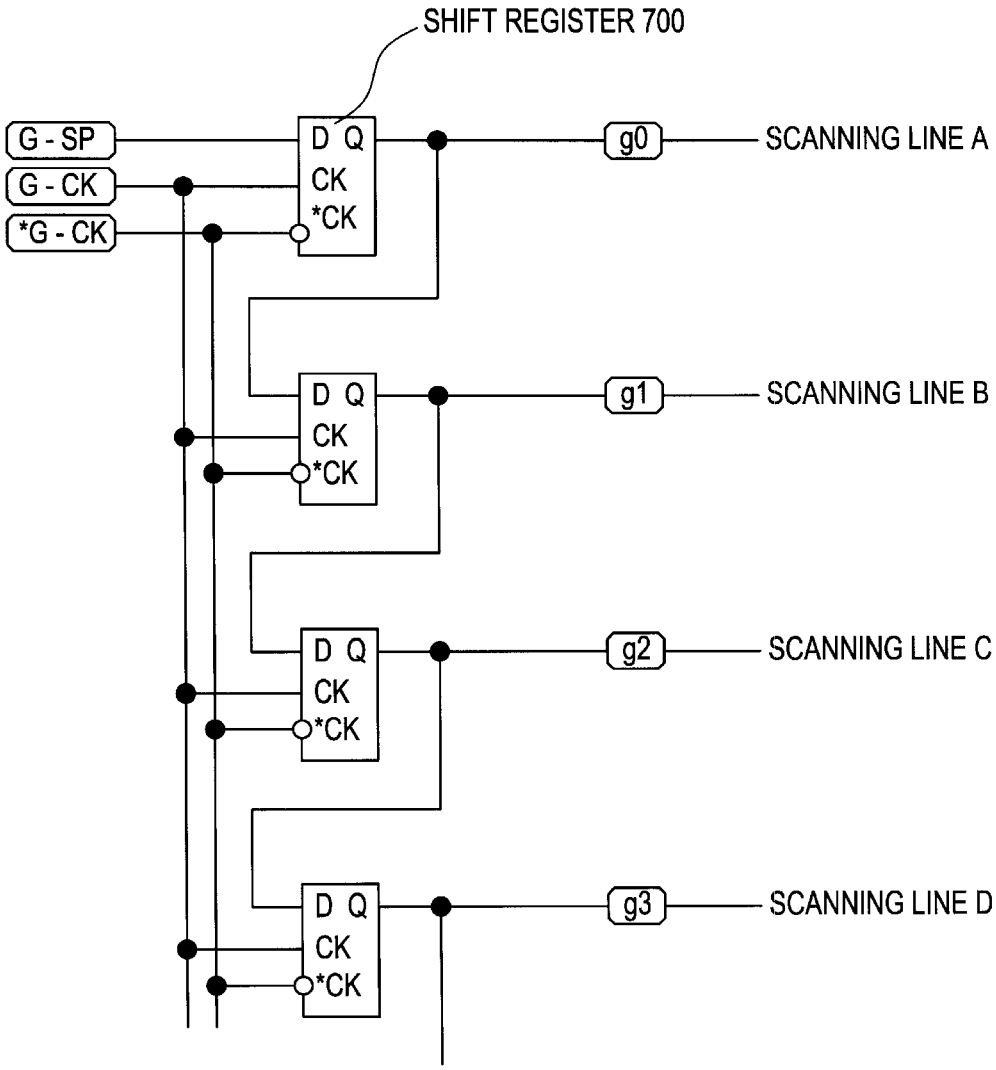
FIG. 7 is a view showing an example (embodiment 2) of a gate driver circuit of the driver circuit of the present invention.
Figure 8:
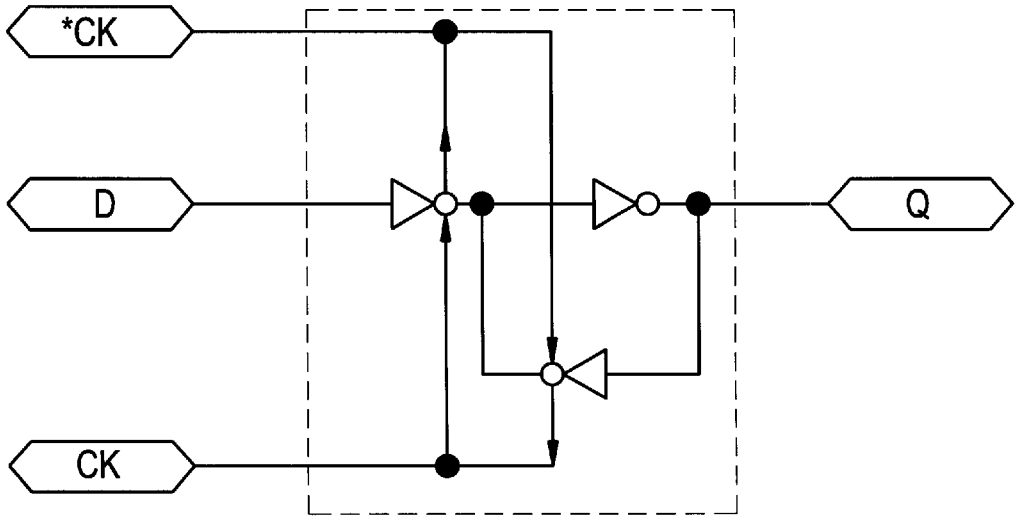
FIG. 8 is a view showing an example (embodiment 2) of a circuit structure of the driver circuit of the present invention.

FIG. 6 is a schematic view showing the periphery of the source driver circuit 505, and FIG. 7 is a schematic view showing the periphery of the gate driver circuit 504. FIG. 8 is a circuit diagram showing an example of a shift register used for the respective driver circuits.

The operation of panel display will be described with reference to FIGS. 5 to 8.

An image signal (VIDEO) from a storage device (magnetic storage medium, magneto-optical storage medium, etc.) storing pictures, a TV tuner, a computer, or the like is prepared. Normally, this image signal (VIDEO) is a signal corresponding to a CRT or the like, and is not a signal suitable for a liquid crystal panel. Thus, various kinds of signal processing must be carried out. Then, the video control circuit 507 carries out processing such as γ correction processing in view of liquid crystal characteristics, analog/digital (A/D) conversion processing and digital/analog (D/A) conversion processing for facilitating correction processes, and dividing processing for decreasing the frequency.

Figures 10, 11:
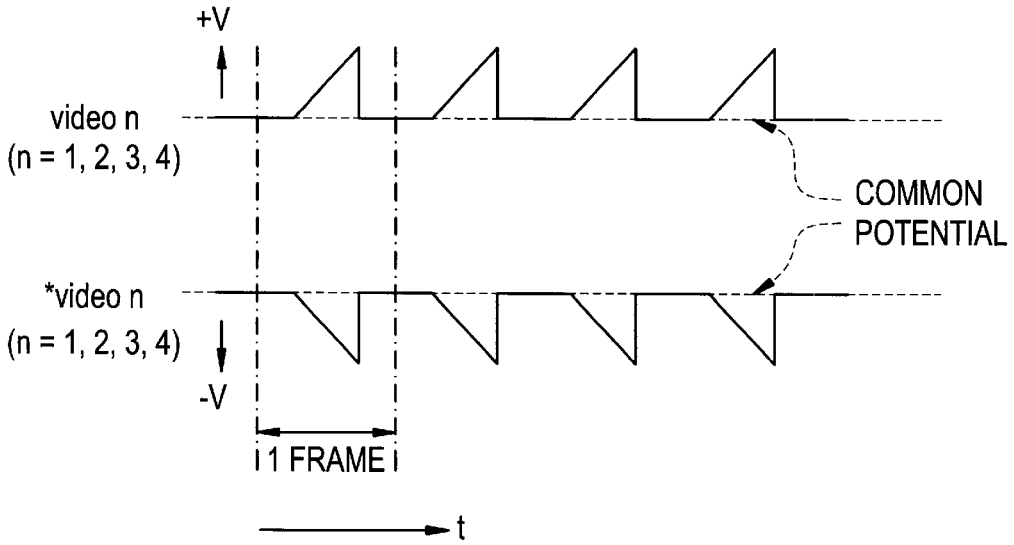
FIG. 10 is a view showing an example (embodiment 2) of a selecting signal of the present invention.
FIG. 11 is a view showing an example (embodiment 2) of correspondence between selecting signals and input signals of the present invention.

In this embodiment, as an example of image signals outputted from the video control circuit 507, image signals (video 1, *video 1, video 2, *video 2, video 3, *video 3, video 4, *video 4) as shown in FIG. 10 are outputted. The relation between the image signal video n (1 to 4) and the *video n (1 to 4) is such that symmetry exists with respect to the common potential, and the image signal having the positive polarity with respect to the common potential is denoted by video n (1 to 4) and the image signal having the negative polarity is denoted by *video n (1 to 4).

Next, the image signals video n (1 to 4) and *video n (1 to 4) are inputted in the selecting circuits 509, 510, 511 and 512 shown in FIG. 5. In this embodiment, input signals Vin1 to Vin4 are formed by using the circuit shown in FIG. 9. In the case where attention is paid to the selecting circuit 509, the input signal Vin1 is formed by a switching element in which when the selecting signal VSEL1 is 0, the image signal video 1 having the positive polarity is outputted, and when the selecting signal VSEL1 is 1, the image signal *video 1 having the negative polarity is outputted. When the selecting circuits 509, 510, 511 and 512 are disposed on an active matrix array substrate, further integration can be made. FIG. 11 shows correspondence between the input signals Vin1 to Vin4 and the selecting signals VSEL1 to VSEL4.

In a conventional panel input signal, its polarity is inverted every frame. On the other hand, the feature of this embodiment, that is, the present invention is that, as is understood when attention is paid to Vin1 to Vin4 in FIG. 13, the polarity is inverted every two frames in each of Vin1 to Vin4. For example, although the polarity of the signal is inverted (positive→negative) in Vin2 after the first one frame, the polarity is not inverted in Vin1 even after the first one frame, and the polarity (positive) of the signal is not changed. Although the polarity of the signal is inverted (negative→positive) in Vin3 after the first one frame, the polarity is not inverted in Vin4 even after the first one frame, and the polarity (negative) of the signal is not changed.

Like this, when the different input signals Vin1 to Vin4 are inputted in the panel and are displayed, four kinds of polarity patterns as shown in FIG. 1A can be displayed.

Thus, although two kinds of disclination patterns are produced as shown in FIG. 1B, they are not recognized as a disclination stripe by a human eye, and the panel display can be made bright.

Four kinds of image signals making four kinds of polarity patterns are formed mainly by this selecting circuit. Incidentally, the selecting circuit is not particularly limited as long as the same function as the circuit shown in FIG. 9 is obtained.

Figure 12:
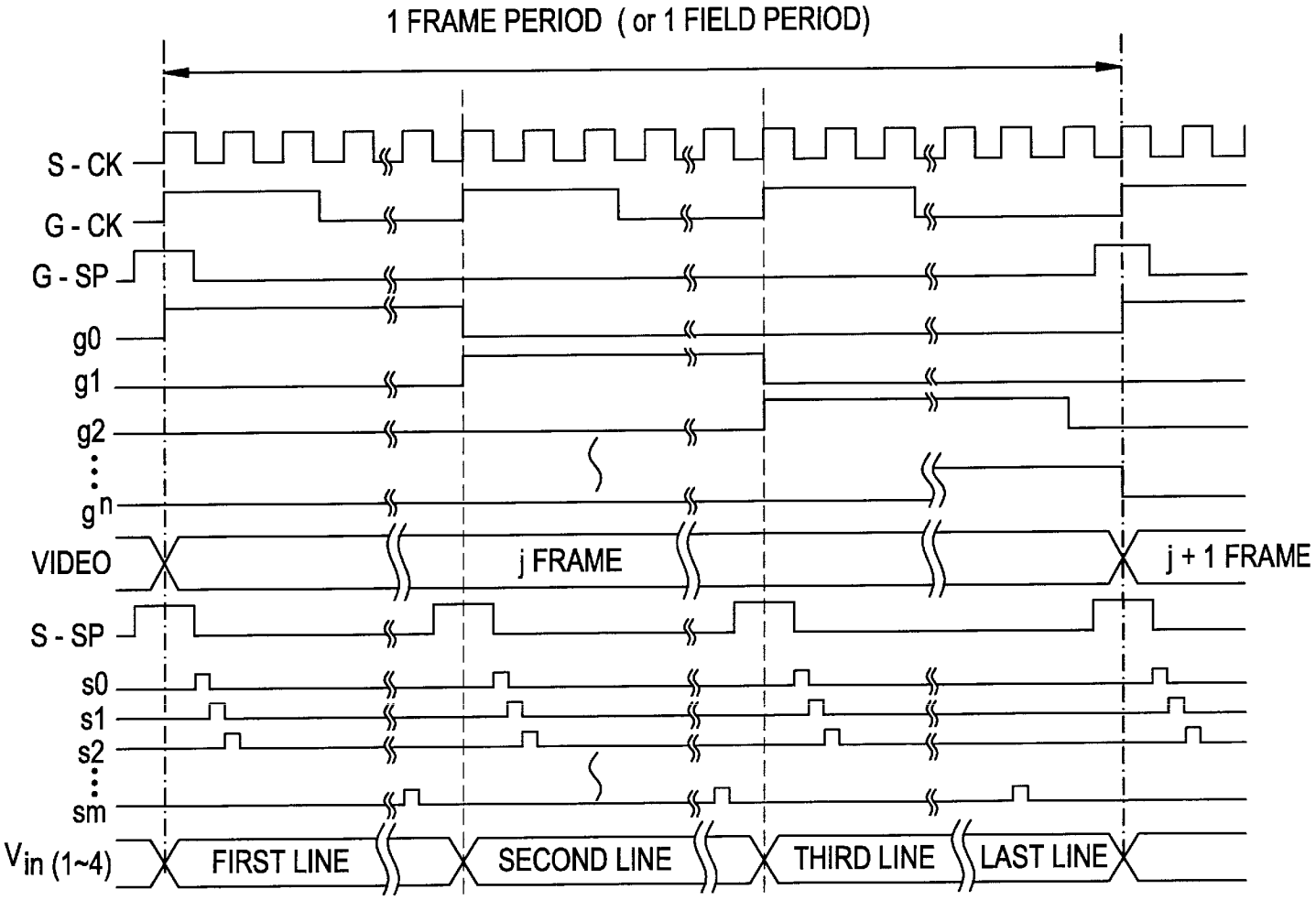
FIG. 12 is a view showing an example (embodiment 2) of a timing chart of the present invention.
Figure 13:
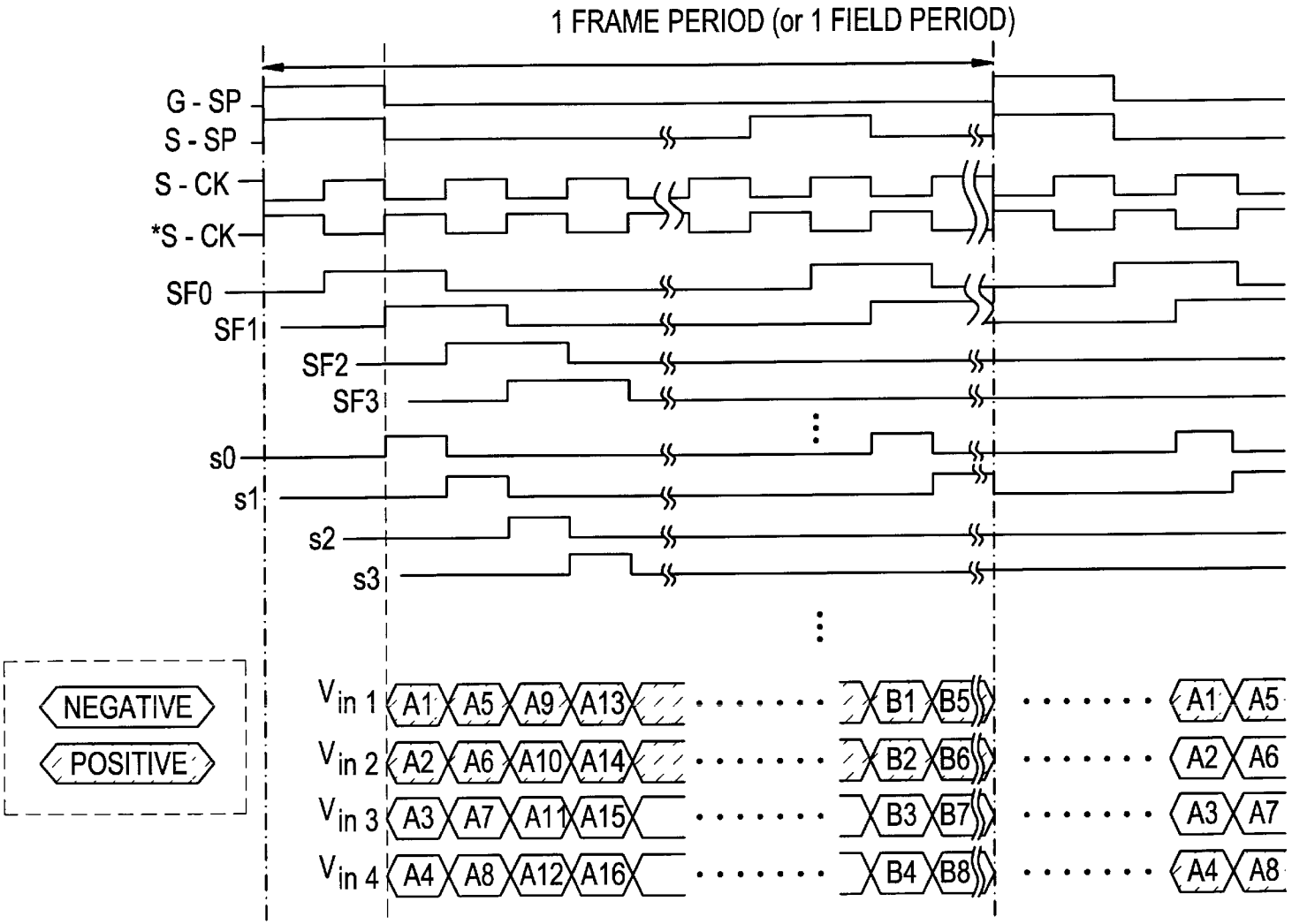
FIG. 13 is a view showing an example (embodiment 2) of a timing chart of the present invention.
Figure 14A:
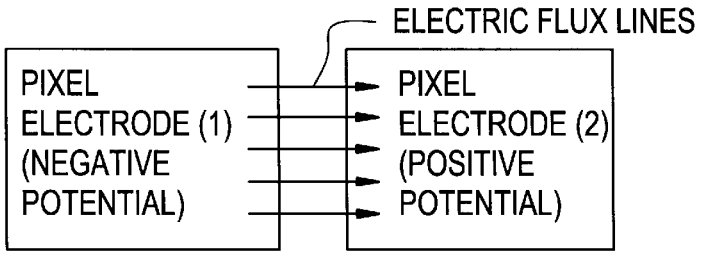
FIGS. 14(A) and 14(B) are status views of electric flux lines produced between adjacent pixels.
Figure 14B:
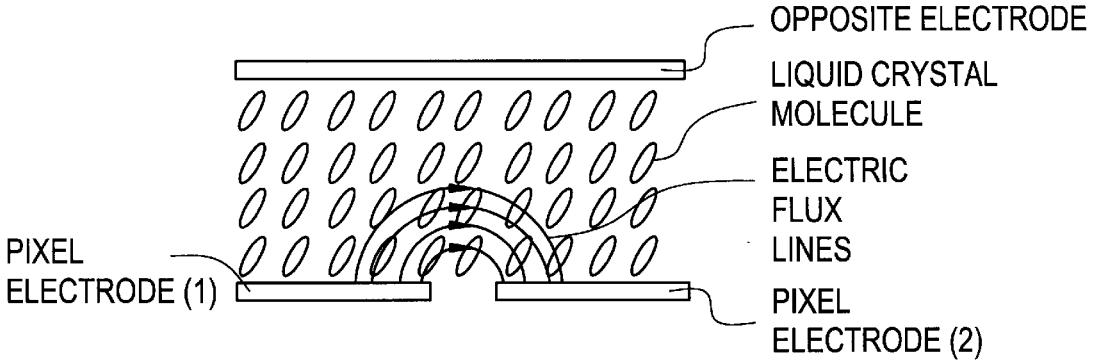

FIG. 12 shows a timing chart of signals (S-CK, G-CK, G-SP, VIDEO, S-SP, Vin (1 to 4)) in FIG. 5 and signals (s0, s1, g0, g1, g2, etc.) in FIG. 6. In addition, FIG. 13 shows a more detailed timing chart. The respective signals (s0, s1, s2, s3, Vin (1 to 4), G-SP, S-CK, S-SP, etc.) in FIG. 13 correspond to those of FIG. 12.

It is needless to say that it is possible to suitably change the order of signal processing till the four kinds of panel input signals are obtained from the image signal 200 according to the circuit design.

That is, in this embodiment, since an image signal is divided into four, the image signal having a relatively high frequency band region can be made to have a low frequency. Moreover, writing is carried out while the polarity of the image signal is inverted for every plural lines (two lines) at the same time, so that the display can be made brighter by about 20% as compared with the conventional case (every one line), and the liquid crystal panel with no flicker can be obtained.

Embodiment 3

Although the above respective embodiments mainly state the liquid crystal display device which displays Z (Z=4) kinds of polarity patterns on the display region constituted of the display pixels of x rows by y columns (x, y=integer), the present invention is not limited to this as long as the liquid crystal display device displays Z (Z>2) kinds of polarity patterns. Alternatively, the present invention is not limited as long as the liquid crystal display device has no less than two kinds of disclination patterns. Incidentally, Z is an integer not less than 3.

For example, the polarity of three lines is made inverted at the same time, so that Z kinds (maximum six kinds) of polarity patterns and three kinds of disclination patterns can be displayed. Further, the polarity of four lines is made inverted at the same time, so that Z kinds (maximum 24 kinds) of polarity patterns and four kinds of disclination patterns can be displayed. It is needless to say that more lines can be inverted at the same time.

Further, it is conceivable that the number of lines inverted at the same time is changed every frame period, so that plural polarity patterns and plural disclination patterns are displayed. For example, the polarity is made inverted for every one line in one frame period, and the polarity is made inverted for every two lines in the next frame period, so that Z kinds (Z=4) of polarity patterns and two kinds of disclination patterns are displayed, and the brightness of display can be improved.

In addition to the inversion methods of the above respective embodiments, by suitably combining the number of lines, the polarity of which is inverted at the same time, with the number of lines, the polarity of which is inverted every frame period at the same time, various polarity patterns and disclination patterns can be formed, and excellent display characteristics can be obtained.

Embodiment 4

Figure 21:
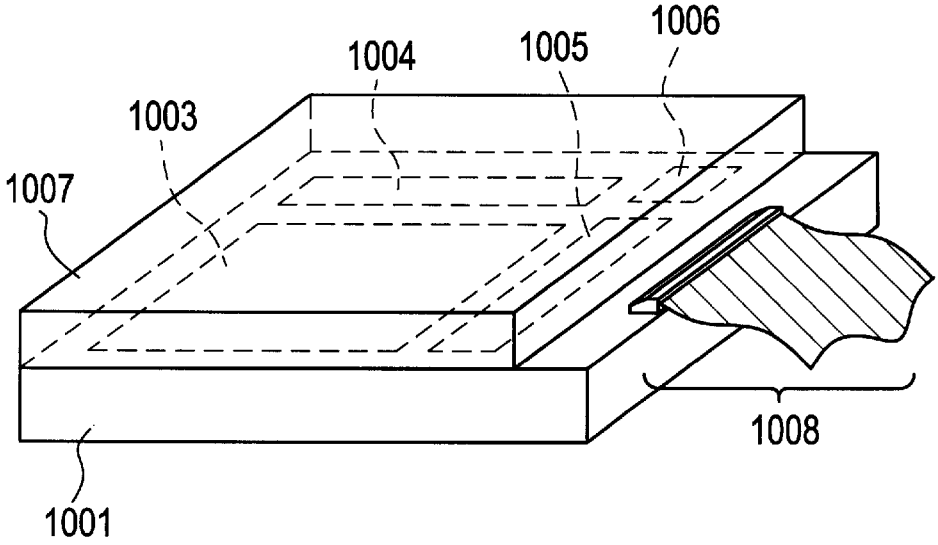
FIG. 21 is a view showing an example of the external appearance of a liquid crystal panel.

FIG. 21 shows an example of a liquid crystal display device including the structure shown in the embodiments 1 to 3. FIG. 21 shows a portion corresponding to the main body of the liquid crystal display device, which is also called a liquid crystal module.

In FIG. 21, reference numeral 1001 denotes a substrate, 1003 denotes a pixel matrix circuit, 1004 denotes a gate side driver circuit, 1005 denotes a source side driver circuit, and 1006 denotes a logic circuit. An opposite substrate 1007 is bonded to a substrate provided with such circuits. A liquid crystal layer (not shown) is held between the circuit substrate and the opposite substrate 1007. A part of an active matrix substrate is exposed, and an FPC (Flexible Printed Circuit) 1008 is attached thereto. An IC chip (semiconductor circuit constituted of MOSFETs formed on single crystal silicon) may be disposed here as the need arises.

Embodiment 5

In this embodiment, examples of electronic equipments (applied products) each including an electro-optical device using the present invention will be shown in FIGS. 22A to 22F. Incidentally, the electronic equipment means a product incorporating a semiconductor circuit and/or an electro-optical device.

As the electronic equipments to which the present invention can be applied, a video camera, an electronic still camera, a projector, a head mount display, a car navigation system, a personal computer, a portable information terminal (mobile computer, portable telephone, PHS (Personal Handyphone System), etc.), and the like are enumerated.

Figure 22A:
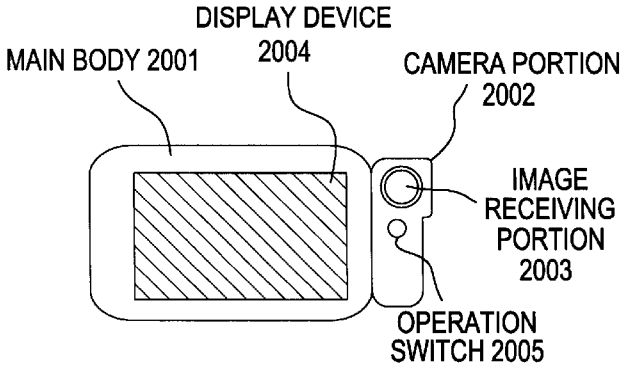
FIGS. 22A to 22F are views showing examples of electric equipments.

FIG. 22A shows a mobile computer which is constituted of a main body 2001, a camera portion 2002, an image receiving portion 2003, an operation switch 2005, and a display device 2004. The present invention can be applied to the camera portion 2002, the image receiving portion 2003, the display device 2004, and the like.

Figure 22B:
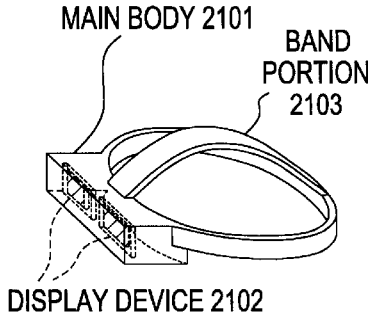

FIG. 22B shows a head mount display which is constituted of a main body 2101, a display device 2102, and a band portion 2103. The present invention can be applied to the display device 2102.

Figure 22C:
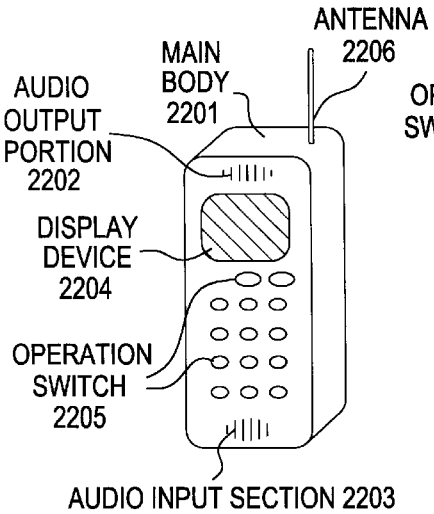

FIG. 22C shows a portable telephone which is constituted of a main body 2201, an audio output portion 2202, an audio input portion 2203, a display device 2204, an operation switch 2205, and an antenna 2206. The present invention can be applied to the audio output portion 2202, the audio input portion 2203, the display device 2204, and the like.

Figure 22D:
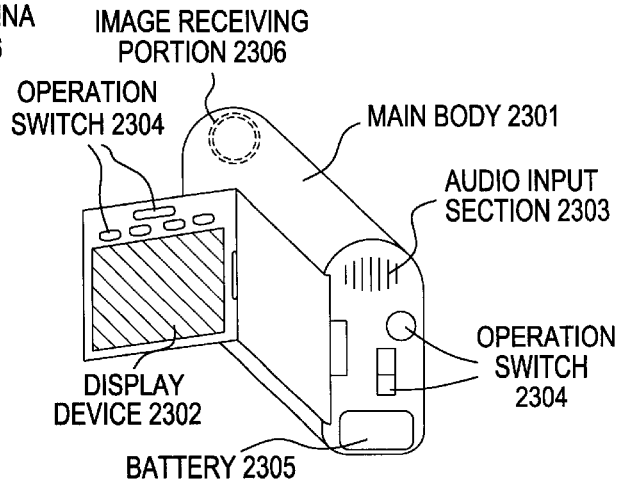

FIG. 22D shows a video camera which is constituted of a main body 2301, a display device 2302, an audio input portion 2303, an operation switch 2304, a battery 2305, and an image receiving portion 2306. The present invention can be applied to the display device 2302, the audio input portion 2303, the image receiving portion 2306, and the like.

Figure 22E:
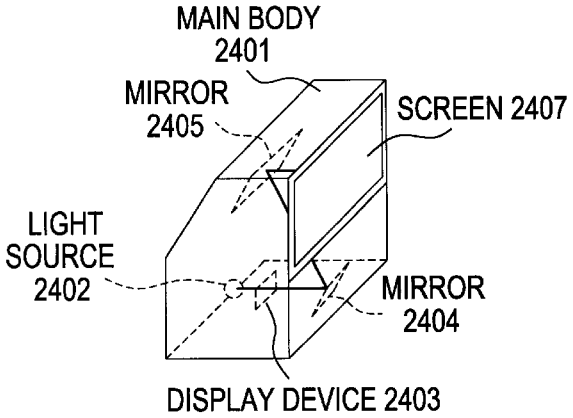

FIG. 22E shows a rear type projector which is constituted of a main body 2401, a light source 2402, a display device 2403, a polarizing beam splitter 2404, reflectors 2405 and 2406, and a screen 2407. The present invention can be applied to the display device 2403.

Figure 22F:
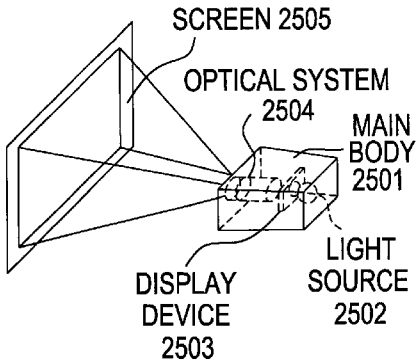

FIG. 22F shows a front type projector which is constituted of a main body 2501, a light source 2502, a display device 2503, an optical system 2504, and a screen 2505. The present invention can be applied to the display device 2503.

As set forth above, the scope of application of the present invention is extremely wide and the present invention can be applied to electronic equipments of any field. Moreover, the present invention can be applied to any product as long as it requires an electro-optical device or a semiconductor circuit.

As described above, according to the structure of the present invention, as compared with the number of disclination stripes produced by the conventional source line inversion driving and gate line inversion driving, the number of disclination stripes can be reduced. Thus, as compared with the conventional source line inversion driving and the gate line inversion driving, bright display can be obtained. Moreover, flicker which has occurred in the frame inversion driving does not occur.

Moreover, since not less than two different disclination patterns exist, the disclination can not be recognized as a stripe by a human eye.

Although the polarity pattern of the present invention is displayed every frame interval, the polarity of the image signal applied to each of the display pixels is inverted every plural frame periods. Thus, even if an image signal with a very fast dot clock is used, the polarity inversion period of the image signal can be prolonged several times that of the conventional one.

Moreover, even if an image signal with a very fast dot clock is used, it is possible to sufficiently drive even a liquid crystal material with a slow speed (several tens ms to hundreds ms) of response from application of voltage. Further, a liquid crystal material (for example, ferroelectric liquid crystal, antiferroelectric liquid crystal, etc.) with a high speed of response is used, it is possible to use an image signal with a faster dot clock. Especially, it is preferable to use the antiferroelectric liquid crystal material with no threshold value.

Thus, according to the structure of the present invention, the picture display can be made brighter than the display by the conventional source line inversion driving and gate line inversion driving, and flicker which has occurred in the conventional frame inversion driving can be eliminated.

What is claimed is:

1. A liquid crystal display device comprising a liquid crystal panel, the liquid crystal panel including:

a pair of substrates; and a liquid crystal sealed between the substrates, one of the substrates being provided with N scanning lines, M signal lines, and M×N display pixels respectively disposed at each of crossing portions between the scanning lines and the signal lines, and an image signal having a positive or negative polarity being applied to each of the display pixels so as to make image display;

wherein image signals having a same polarity are applied for every n ($M>n\geqq 2$) adjacent lines of the signal lines; and wherein a boundary portion between a group of the display pixels connected to the n signal lines applied with the image signals having the positive polarity and a group of the display pixels connected to the n signal lines applied with the image signals having the negative polarity is periodically moved.

2. A device according to claim 1, wherein the boundary portion is moved every frame or field interval.

3. A device according to claim 1, wherein the liquid crystal panel includes at least two image signal wiring lines, and the image signal wiring lines include a first image signal wiring line applied with the image signal having the positive polarity, and a second image signal wiring line applied with the image signal having the negative polarity.

4. A device according to claim 1, wherein the liquid crystal panel includes a switching element at each of the crossing portions between the scanning lines and the signal lines, and wherein the scanning lines, the signal lines, and the switching element are formed on the same substrate.

5. A device according to claim 1, wherein the liquid crystal panel includes a polarity selecting circuit for selecting the polarity of the image signal applied to the signal lines, and wherein the signal lines, the scanning lines, a switching element, and the polarity selecting circuit are formed on the same substrate.

6. An active matrix type liquid crystal display device, comprising:

a display region constituted of display pixels arranged in a matrix form, an image signal having a positive or negative polarity being written in each of the display pixels so as to make an image display, a polarity of the image signal applied to source lines being inversed every 2 or more lines; and a circuit for forming the image signal which sequentially displays at least four kinds of polarity patterns on the display region.

7. A device according to claim 6, further comprising a circuit which sequentially displays at least four kinds of polarity patterns on the display region every frame or field interval, and sequentially displays them in one period of frames the number of which is the same as that of the kinds of polarity patterns.

8. A device according to claim 6, further comprising a circuit which inverts the polarity of the image signal applied to each of the display pixels every plural frame or plural field periods.

9. A method of driving an active matrix type liquid crystal display device which includes a display region constituted of display pixels of x rows by y columns arranged in a matrix form and in which image signals are applied to a first group of n signal lines with a first polarity and to a second group of n signal lines with a second polarity opposite to the first polarity where n is an integer of two or more in a first frame or a first field, wherein image signals having the second polarity are applied to at least one of the n signal lines of the first group and image signals having the first polarity are applied to at least one of the n signal lines of the second group in a second frame or a second field subsequent to the first frame or the first field, wherein z kinds of polarity patterns are displayed on the display region where z is an integer of three or more.

10. A method according to claim 9, wherein the Z kinds of polarity patterns are displayed every frame interval, and are sequentially displayed in one period of Z frames.

11. A method according to claim 9, wherein the Z (Z=4) kinds of polarity patterns are sequentially displayed on the display region constituted of the display pixels of x rows by y columns arranged in a matrix form.

12. An active matrix type liquid crystal display device comprising a liquid crystal panel with a display region, the display region including: a pair of substrates; and a liquid crystal sealed between the substrates, one of the substrates being provided with N scanning lines, M signal lines, N×M display pixels respectively disposed at each of crossing portions between the scanning lines and the signal lines, and image signals are applied to a first group of n signal lines with a first polarity and to a second group of n signal lines with a second polarity opposite to the first polarity where n is an integer of two or more in a first frame or a first field, wherein image signals having the second polarity are applied to at least one of the n signal lines of the first group and image signals having the first polarity are applied to at least one of the n signal lines of the second group in a second frame or a second field subsequent to the first frame or the first field, wherein at least two kinds of disclination patterns occurred between the first group and the second group are displayed on the display region.

13. A method of driving an active matrix type liquid crystal display device which comprises a liquid crystal sealed between a pair of substrates, and a display region constituted of display pixels arranged in a matrix form, in which image signals are applied to a first group of n signal lines with a first polarity and to a second group of n signal lines with a second polarity opposite to the first polarity where n is an integer of two or more in a first frame or a first field, wherein image signals having the second polarity are applied to at least one of the n signal lines of the first group and image signals having the first polarity are applied to at least one of the n signal lines of the second group in a second frame or a second field subsequent to the first frame or the first field, wherein at least two kinds of different disclination patterns occurred between the first group and the second group are displayed on the display region.

14. A method according to claim 13, wherein the disclination patterns are sequentially displayed on the display region every frame or field interval.

15. A video camera having the liquid crystal display device of claim 1.

16. An electronic still camera having the liquid crystal display device of claim 1.

17. A projector having the liquid crystal display device of claim 1.

18. A head mount display having the liquid crystal display device of claim 1.

19. A car navigation system having the liquid crystal display device of claim 1.

20. A personal computer having the liquid crystal display device of claim 1.

21. A portable information terminal having the liquid crystal display device of claim 1.

22. A video camera having the liquid crystal display device of claim 6.

23. An electronic still camera having the liquid crystal display device of claim 6.

24. A projector having the liquid crystal display device of claim 6.

25. A head mount display having the liquid crystal display device of claim 6.

26. A car navigation system having the liquid crystal display device of claim 6.

27. A personal computer having the liquid crystal display device of claim 6.

28. A portable information terminal having the liquid crystal display device of claim 6.

29. A video camera having the liquid crystal display device of claim 12.

30. An electronic still camera having the liquid crystal display device of claim 12.

31. A projector having the liquid crystal display device of claim 12.

32. A head mount display having the liquid crystal display device of claim 12.

33. A car navigation system having the liquid crystal display device of claim 12.

34. A personal computer having the liquid crystal display device of claim 12.

35. A portable information terminal having the liquid crystal display device of claim 12.

36. A method of driving an active matrix type liquid crystal display device comprising the steps of:

during a first frame, applying first image signals to a first group of n signal lines with a first polarity and a second-group of n signal lines with a second polarity opposite to said first polarity, wherein said first group of the n signal lines is adjacent to said second group of the n signals with a first boundary therebetween where n is 2 or more; and during a second frame subsequent to said first frame, applying second image signals to a third group of n signal lines with the first polarity and a fourth group of n signal lines with the second polarity wherein said third group of the n signal lines is adjacent to said fourth group of the n signal lines with a second boundary therebetween, said second boundary being in a different position from said first boundary, wherein said third group of n signal lines includes at least one signal line of the first group of n signal lines, and said fourth group of n signal lines includes at least one signal line of the first group of n signal lines.

37. A method of driving an active matrix type liquid crystal device comprising the steps of:

during a first field, applying first image signals to a first group of n signal lines with a first polarity and a second group of n signal lines with a second polarity opposite to said first polarity, wherein said first group of the n signal lines is adjacent to said second group of the n signals with a first boundary therebetween where n is 2 or more; and during a second field subsequent to said first frame, applying second image signals to a third group of n signal lines with the first polarity and fourth group of n signal lines with the second polarity wherein said third group of the n signal lines is adjacent to said fourth group of the n signal lines with a second boundary therebetween said second boundary being in a different position from said first boundary, wherein said third group of n signal lines includes at least one signal line of the first group of n signal lines, and said fourth group of n signal lines includes at least one signal line of the first group of n signal lines.

* * * * *

UNITED STATES PATENT AND TRADEMARK OFFICE

CERTIFICATE OF CORRECTION

PATENT NO. : 6,496,172 B1
APPLICATION NO. : 09/276757
DATED : December 17, 2002
INVENTOR(S) : Yoshiharu Hirakata It is certified that error appears in the above-identified patent and that said Letters Patent is hereby corrected as shown below:

Claim 37, line 10, Col. 20, replace "first frame" with --first field--.

Signed and Sealed this

Thirty-first Day of October, 2006

JON W. DUDAS
*Director of the United States Patent and Trademark Office*